US011409215B2

(12) United States Patent
Yoshida et al.

(10) Patent No.: US 11,409,215 B2
(45) Date of Patent: Aug. 9, 2022

(54) INFORMATION PROCESSING APPARATUS, CONTROL METHOD, AND STORAGE MEDIUM

(71) Applicant: CANON KABUSHIKI KAISHA, Tokyo (JP)

(72) Inventors: Satoshi Yoshida, Kawasaki (JP); Nobuhiro Kawamura, Nagareyama (JP); Hiroya Igarashi, Toride (JP); Toru Shinnae, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 16/990,832

(22) Filed: Aug. 11, 2020

(65) Prior Publication Data

US 2021/0063931 A1 Mar. 4, 2021

(30) Foreign Application Priority Data

Aug. 30, 2019 (JP) ..... JP2019-158666

(51) Int. Cl.
*G03G 15/00* (2006.01)
*B65H 7/20* (2006.01)
*B65H 5/06* (2006.01)

(52) U.S. Cl.
CPC ..... *G03G 15/50* (2013.01); *B65H 5/062* (2013.01); *B65H 7/20* (2013.01); *G03G 15/6529* (2013.01); *B65H 2513/10* (2013.01)

(58) Field of Classification Search
CPC .... G03G 15/50; G03G 15/65; G03G 15/6529; G03G 15/6555; G03G 15/706; G03G 2215/00556; G03G 2215/00561; G03G 2215/00746; G03G 2215/00945; G03G 2215/00949; B65H 5/062; B65H 7/20; B65H 43/00; B65H 2513/10; B65H 2511/416; B41J 13/0027
See application file for complete search history.

(56) References Cited

U.S. PATENT DOCUMENTS

2015/0316887 A1* 11/2015 Zhu ..... G03G 15/70 399/21
2019/0184719 A1 6/2019 Matsuura
2020/0201224 A1* 6/2020 Okuzawa

FOREIGN PATENT DOCUMENTS

JP 2007-065145 A 3/2007
JP 2018-086766 A 6/2018

* cited by examiner

*Primary Examiner* — Sophia S Chen
(74) *Attorney, Agent, or Firm* — Canon U.S.A., Inc. I.P. Division

(57) ABSTRACT

An information processing apparatus to control an image forming system includes a reception unit and a control unit. The image forming system includes a first conveyance unit configured to convey a recording medium and a second conveyance unit located downstream of the first conveyance unit in a conveyance route of the recording medium. The reception unit receives an instruction to set a conveyance speed of the first conveyance unit. The control unit sets the conveyance speed of the first conveyance unit to the image forming system based on the setting instruction, and sets a conveyance speed of the second conveyance unit to the image forming system based on the instruction to set the conveyance speed of the first conveyance unit.

14 Claims, 15 Drawing Sheets

FIG.5C

NEW REGISTRATION/EDITING ×

510

*NAME: 511

PLAIN PAPER_ADJUSTED

*GRAMMAGE: 90 g/m²

COLOR: WHITE

*SURFACE TEXTURE: HIGH-QUALITY PAPER

*SIZE: A4 mm INCH

X: mm (182.0-762.0)

Y: mm (139.7-330.2)

CHARACTERISTICS: NONE

FIBER DIRECTION SETTINGS: OFF

SECOND SIDE OF TWO-SIDED PAGE:
- NOT SET
- SET

FAVORITES:
- (1) FAVORITE 1
- (2) FAVORITE 2
- (3) FAVORITE 3

REGISTER/EDIT...

FIELDS MARKED WITH * ARE REQUIRED

ADJUSTMENT: 513

DISPLAYED GROUP: ALL

| SETTING ITEM | ADJUSTED/NOT ADJUSTED | DISPLAYED GROUP |
|---|---|---|
| TONER AMOUNT ADJUSTMENT MODE | NOT ADJUSTED | IMAGE QUALITY |
| ADJUSTMENT OF PRIMARY TRANSFER VOLTAGE | NOT ADJUSTED | IMAGE QUALITY |
| ADJUSTMENT OF IMAGE POSITION | NOT ADJUSTED | IMAGE POSITION |
| ADJUSTMENT OF LEADING EDGE AND TAILING EDGE MARGINS | NOT ADJUSTED | IMAGE POSITION |
| ADJUSTMENT OF SPEED OF SECONDARY TRANSFER BELT | NOT ADJUSTED | IMAGE POSITION |
| ADJUSTMENT OF FAN LEVEL OF SHEET FAN | NOT ADJUSTED | SHEET CONVEYANCE |
| ADJUSTMENT OF SHEET CONVEYANCE AT THE TIME OF TWO-SIDED PRINTING | NOT ADJUSTED | SHEET CONVEYANCE |
| ADJUSTMENT OF SHEET CONVEYANCE OF CONVEYANCE UNIT BEFORE FIXING | NOT ADJUSTED | SHEET CONVEYANCE |
| ADJUSTMENT OF SHEET CONVEYANCE OF FIRST FIXING UNIT | NOT ADJUSTED | SHEET CONVEYANCE |
| ADJUSTMENT OF SHEET CONVEYANCE OF SECOND FIXING UNIT 514 | NOT ADJUSTED | SHEET CONVEYANCE |
| ADJUSTMENT OF SHEET CONVEYANCE OF BYPASS UNIT | NOT ADJUSTED | SHEET CONVEYANCE |
| ADJUSTMENT OF SHEET CONVEYANCE OF REVERSING/SHEET DISCHARGE UNIT | NOT ADJUSTED | SHEET CONVEYANCE |
| CURL CORRECTION AMOUNT | NOT ADJUSTED | CURL CORRECTION |
| ADJUSTMENT OF CREEP (DISPLACEMENT) CORRECTION AMOUNT | NOT ADJUSTED | FINISHING PROCESSING |
| ADJUSTMENT OF SADDLE FOLD POSITION | NOT ADJUSTED | FINISHING PROCESSING |
| SADDLE STITCH SETTINGS | NOT ADJUSTED | FINISHING PROCESSING |
| CHANGE OF PUNCH HOLE POSITION | NOT ADJUSTED | FINISHING PROCESSING |

ADJUSTMENT OF SHEET CONVEYANCE OF CONVEYANCE UNIT BEFORE FIXING

ADJUSTMENT OF SHEET CONVEYANCE OF CONVEYANCE UNIT BEFORE FIXING: 0

512 EDIT...

OK CANCEL

FIG.7

700

| 701 SETTING ITEM | 702 CONVEYANCE ORDER | 703 LOWER LIMIT VALUE | 704 UPPER LIMIT VALUE | 705 SETTING VALUE |
|---|---|---|---|---|
| ADJUSTMENT OF SHEET CONVEYANCE OF CONVEYANCE UNIT BEFORE FIXING | 1 | -128 | +128 | -5 |
| ADJUSTMENT OF SHEET CONVEYANCE OF FIRST FIXING UNIT | 2 | -128 | +128 | 0 |
| ADJUSTMENT OF SHEET CONVEYANCE OF SECOND FIXING UNIT | 3 | -128 | +128 | -10 |
| ADJUSTMENT OF SHEET CONVEYANCE OF BYPASS UNIT | 4 | -128 | +128 | +30 |
| ADJUSTMENT OF SHEET CONVEYANCE OF REVERSING/ SHEET DISCHARGE UNIT | 5 | -128 | +128 | +15 |

UPSTREAM

DOWNSTREAM

CLICK DETAILS/EDIT

FIG.9

520

ADJUSTMENT OF SHEET CONVEYANCE OF FIRST FIXING UNIT

CHANGING THE ADJUSTMENT VALUE AFFECTS THE CONVEYANCE OF THE SHEET. BECAUSE LARGELY CHANGING THE NUMERICAL VALUE MAY CAUSE A PAPER JAM, GRADUALLY TRYING A NEW VALUE STARTING FROM A SMALL CHANGE IS RECOMMENDED.

ADJUSTMENT VALUE: 901

0 — + (-118 – +98)

THE CHANGE IN THE ADJUSTMENT VALUE WILL ALSO BE REFLECTED IN THE FOLLOWING SETTING ITEM(S).

- ADJUSTMENT OF SHEET CONVEYANCE OF SECOND FIXING UNIT
- ADJUSTMENT OF SHEET CONVEYANCE OF BYPASS UNIT
- ADJUSTMENT OF SHEET CONVEYANCE OF REVERSING/SHEET DISCHARGE UNIT

OK CANCEL

INFORMATION PROCESSING APPARATUS, CONTROL METHOD, AND STORAGE MEDIUM

This application claims the benefit of Japanese Patent Application No. 2019-158666, filed Aug. 30, 2019, which is hereby incorporated by reference herein in its entirety.

BACKGROUND

Field

The present disclosure relates to control for setting a conveyance speed of a recording medium in an image forming apparatus.

Description of the Related Art

Image forming apparatuses for use in production printing have a wide variety of adjustable items therein, and therefore setting an optimum value for setting each of the items results in complicated work for users.

Under these circumstances, Japanese Patent Application Laid-Open No. 2018-86766 discusses a system configured to allow a sheet and the like of an image forming apparatus to be intuitively set from software installed in an external apparatus.

Examples of the items which can be set include the adjustment values of a transfer voltage and an image position, and include items such as the name, the size, and the grammage of a sheet used for each sheet feeding deck.

Further, a sheet feeding apparatus for increasing an amount of feedable sheets (the number of replenishable sheets), and a post-processing apparatus for performing various kinds of finishing processing on sheets can be connected to the image forming apparatus. A motor for sheet conveyance is provided to each of the image forming apparatus, the sheet feeding apparatus, and the post-processing apparatus. The sheet feeding apparatus and the post-processing apparatus can change the conveyance speed of the motor for sheet conveyance to allow them to be connected to a plurality of types of image forming apparatuses.

An image forming apparatus discussed in Japanese Patent Application Laid-Open No. 2007-065145 acquires a plurality of respective sheet conveyance speeds of a reception portion of an image forming unit, a discharge portion of the image forming unit, a sheet feeding unit, and a post-processing unit when the image forming apparatus is powered on. Then, the image forming apparatus instructs these units to satisfy the highest conveyance speed at which the sheet can be conveyed at each of the units in common.

There is a plurality of conveyance units in the conveyance route of the sheet, and the conveyance speed is to be set with respect to each of the units. The presence of any inconsistency in the setting of the conveyance speed among the units, if any, undesirably leads to, for example, wrinkles created on the sheet, and thus the occurrence of a paper jam in the middle of the conveyance.

For example, when the speed of a downstream unit is excessively high compared to the conveyance speed of a unit on the upstream side in the conveyance path, a mark wrinkled in an undulating manner may be seen on the print product.

In this case, such a symptom can be improved by adjusting the setting value to reduce the speed of the downstream unit.

However, making such an adjustment requires the user to confirm the setting content of the conveyance speed of the upstream unit in the conveyance path, and adjust the conveyance speed of the downstream unit while choosing the setting value to make the conveyance speed consistent between the upstream unit and the downstream unit.

Further, when a change is made to the conveyance speed of one unit among the plurality of conveyance units, failing to also change the setting of the conveyance speed of a unit existing downstream of this unit along therewith undesirably makes the conveyance speed inconsistent among the units. Therefore, the user should also adjust the setting of the conveyance speed of the unit downstream of the unit for which the conveyance speed is changed.

The necessity of making the adjustment in consideration thereof is unclear for the user, and it is difficult for the user to achieve appropriate settings with the conventional method in which the user sets each individual conveyance unit. Further, it is cumbersome for the user to adjust not only the unit for which the user wants to change the conveyance speed but also the setting of the conveyance speed of the downstream unit.

The image forming apparatus discussed in Japanese Patent Application Laid-Open No. 2007-065145 discusses collectively setting the conveyance speed of each of the units when the image forming apparatus is powered on, but does not take into consideration an operation when a change to the setting of the conveyance speed of the individual unit is received. A similar matter also lies in the image forming apparatus discussed in Japanese Patent Application Laid-Open No. 2007-065145 when a change to the setting of the conveyance speed of the individual unit is received.

SUMMARY

In an example, when an operation for setting a conveyance speed of an individual conveyance unit is performed, an information processing apparatus may allow a conveyance speed of each conveyance unit to be adjusted in a way that makes the conveyance speed consistent between an upstream conveyance unit and a downstream conveyance unit in a conveyance path.

According to an aspect of the present disclosure, an information processing apparatus configured to control an image forming system, wherein the image forming system includes a first conveyance unit configured to convey a recording medium and a second conveyance unit located downstream of the first conveyance unit in a conveyance route of the recording medium, includes a reception unit configured to receive an instruction to set a conveyance speed of the first conveyance unit. and a control unit configured to set the conveyance speed of the first conveyance unit to the image forming system based on the setting instruction, and to set a conveyance speed of the second conveyance unit to the image forming system based on the instruction to set the conveyance speed of the first conveyance unit.

Further features of the present disclosure will become apparent from the following description of embodiments with reference to the attached drawings.

BRIEF DESCRIPTION OF THE DRAWINGS

FIG. 5C illustrates a screen for setting the conveyance speed of the conveyance unit according to the first embodiment.

FIG. 7 illustrates a conveyance order, settable ranges, and setting values of a plurality of conveyance units according to the first embodiment.

FIG. 9 illustrates a screen for setting the conveyance speed of the conveyance unit according to a third embodiment.

DESCRIPTION OF THE EMBODIMENTS

In the following description, embodiments of the present disclosure will be described in detail with reference to the attached drawings. However, the embodiments that will be described below do not limit the present disclosure defined in the claims, and not all of combinations of features that will be described in the present embodiments are necessarily essential to the solution of the present disclosure.

First Embodiment (Overall Configuration)

Figure 1:
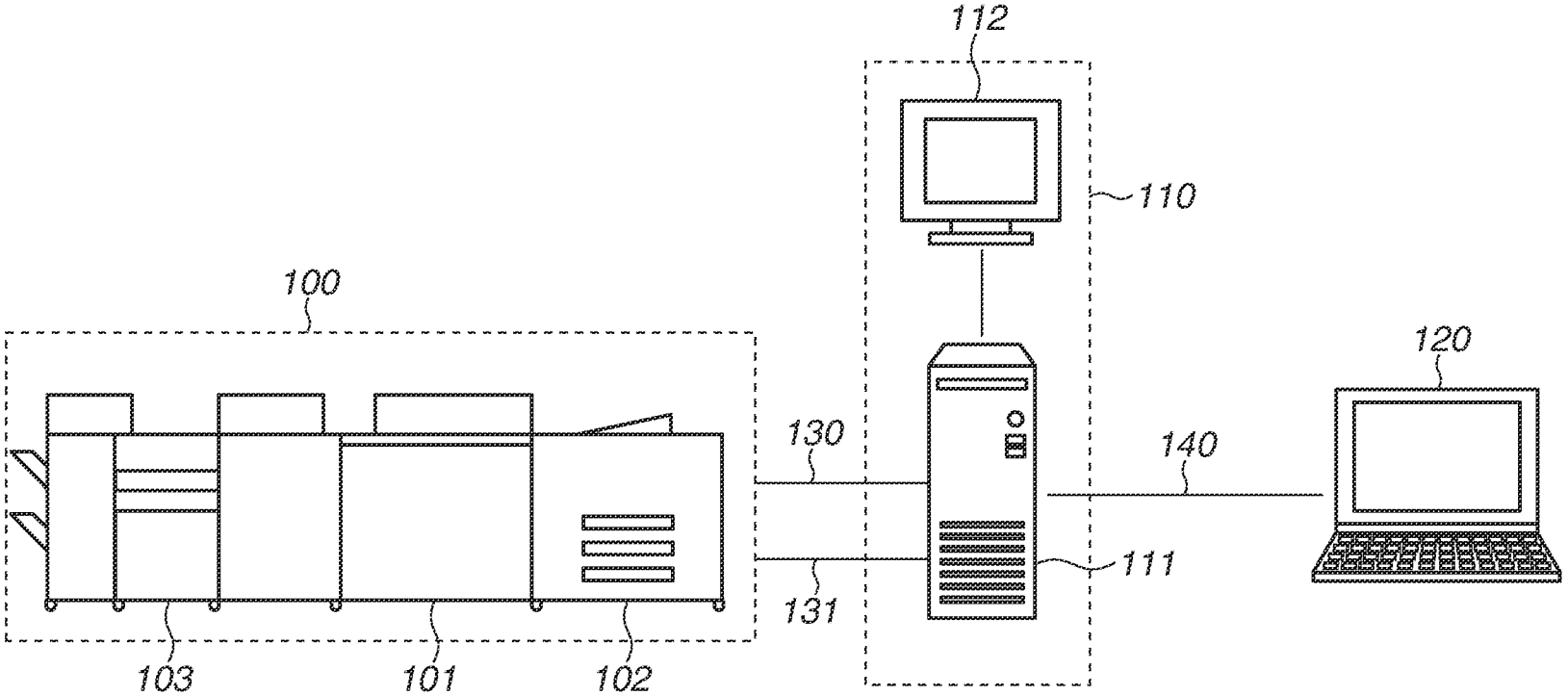
FIG. 1 is a block diagram illustrating the overall configuration of a system according to a first embodiment.

FIG. 1 is a block diagram illustrating the overall configuration of a system according to a first embodiment.

In the present embodiment, a printing control apparatus 110 is connected to an image forming system 100. Further, the printing control apparatus 110 is communicably connected to a client computer 120.

The image forming system 100 and the printing control apparatus 110 are connected to each other via an image video cable 130 and a control cable 131. In this manner, the printing control apparatus 110 communicates with the image forming system 100 via a communication line.

Further, the client computer 120 and the printing control apparatus 110 are communicably connected to each other via a local area network (LAN) 140 using an Ethernet (registered trademark) cable, a repeater/switch connected point-to-point link, a twisted pair cable, a coaxial cable, or the like.

The present embodiment may be configured in such a manner that the image forming apparatus 101 is communicably connected to the client computer 120 directly via the LAN 140 without the intervention of the printing control apparatus 110 therebetween.

The image forming system 100 includes the image forming apparatus 101. A sheet feeding apparatus 102 for increasing an amount of feedable sheets (the number of replenishable sheets), and a post-processing apparatus 103 can be connected to the image forming apparatus 101. The post-processing apparatus refers to, for example, an apparatus for performing finishing processing, such as an apparatus that performs sorting processing, a folding apparatus that performs folding processing, a stapling apparatus that performs stapling processing, and a sheet discharge apparatus that performs sheet discharge processing on sheets (recording media). In the present embodiment, the image forming apparatus 101 alone, or the configuration in which optional apparatuses such as the sheet feeding apparatus 102 and the post-processing apparatus 103 are connected to the image forming apparatus 101 will be referred to as the image forming system 100.

The client computer 120 is an information processing apparatus that causes an application such as a printer driver to operate, thereby, for example, inputting print data to the image forming system 100 and instructing the image forming system 100 to print it. The printing control apparatus 110 and the image forming apparatus 101 perform image processing on the input print data in cooperation with each other.

The printing control apparatus 110 includes a controller unit 111 and a display unit 112. The controller unit 111 of the printing control apparatus 110 is an information processing device capable of performing rendering processing on the print data input from the client computer 120. For example, the controller unit 111 can interpret a drawing command in the page-description language (PDL) format that is input from the client computer 120, and draw (render or rasterize) a rasterized image and output it to the image forming system 100. However, the present embodiment may be configured in such a manner that the image forming apparatus 101 of the image forming system 100 performs the rendering processing.

The display unit 112 displays an operation screen of the printing control apparatus 110. A user can operate the operation screen by operating a not-illustrated keyboard or pointing device. Further, the user can control the input of the print data (a print job) from the printing control apparatus 110 to the image forming system 100 by operating the operation screen displayed on the display unit 112.

The image forming apparatus 101 is a multifunction peripheral having, for example, a scanning function and a printing function. However, the scanning function is not an essential configuration. The image forming apparatus 101 performs image processing based on the print data received from the client computer 120 or the printing control apparatus 110. Further, the image forming apparatus 101, for example, copies and prints out data read in from a scanner unit 213, or transmits it to a shared folder.

The image forming apparatus 101 receives various kinds of instructions from the user via an operation panel 105. The operation panel 105 displays various kinds of information such as the execution status of a job via the panel. Further, the operation panel 105 displays a setting screen that will be described below with reference to FIGS. 8A to 8C. Further, the image forming apparatus 101 includes a sheet discharge unit that discharges a sheet with an image formed thereon.

(Configuration of Image Forming Apparatus 101)

Figure 2:
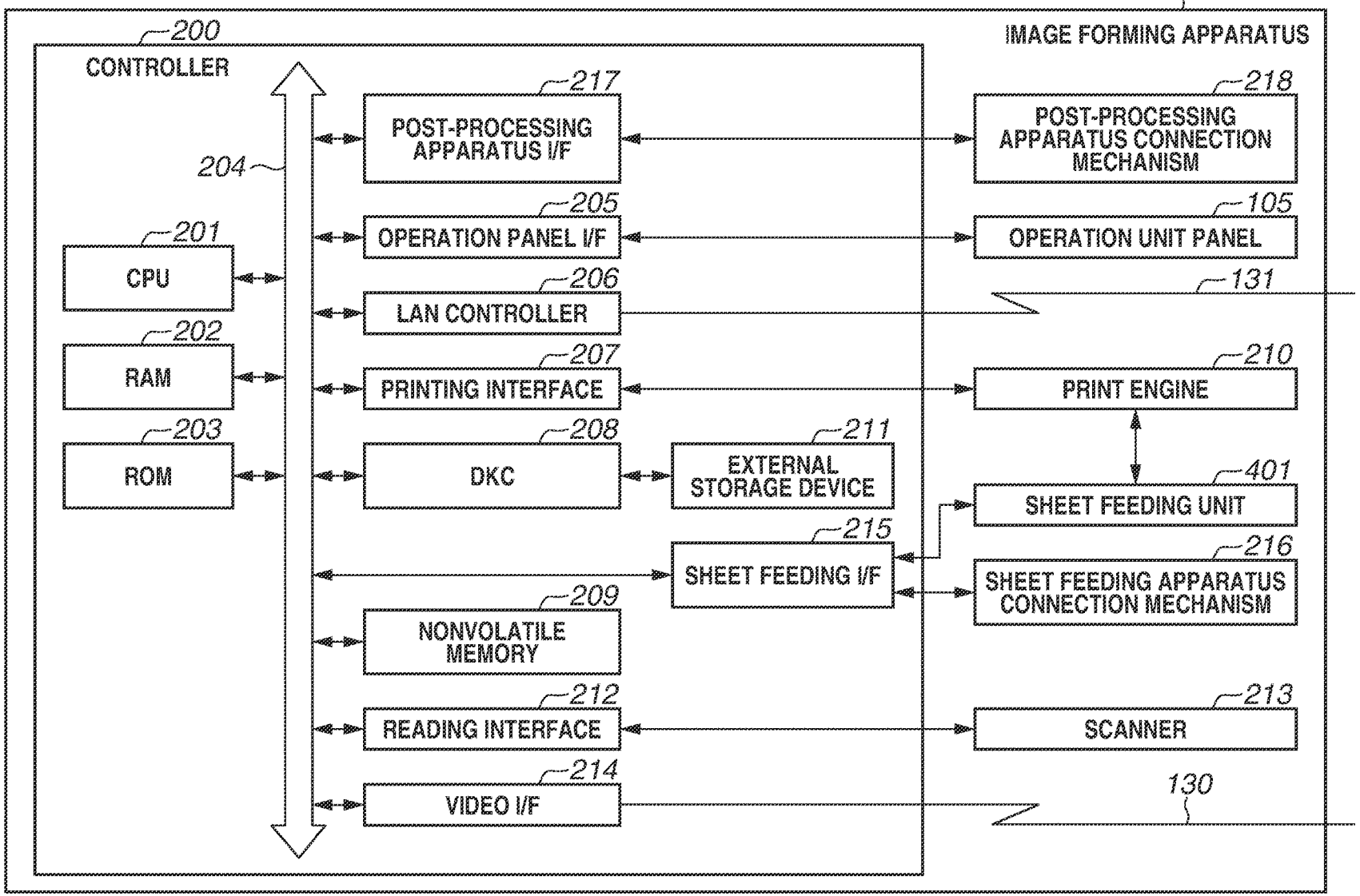
FIG. 2 is a block diagram illustrating the hardware configuration of an image forming apparatus 101 according to the first embodiment.

Next, the hardware configuration of the image forming apparatus 101 according to the present embodiment will be described with reference to FIG. 2.

A controller 200 includes a central processing unit (CPU) 201. The CPU 201 loads a control program stored in a read only memory (ROM) 203 or an external storage device 211 into a random access memory (RAM) 202. The CPU 201 comprehensively controls various kinds of devices connected to a system bus 204 by executing the loaded program.

The CPU 201, for example, outputs an image signal to a print engine 210 (a printing unit) to which the CPU 201 is connected via a printing interface 207, and receives an image signal input from the scanner unit 213 to which the CPU 201 is connected via a reading interface 212. Further, the CPU 201, for example, controls sheet feeding units 401 connected to the print engine 210 and acquires the states of the sheet feeding units 401 via the printing interface 207.

Further, the CPU 201 is configured to be able to perform processing for communicating with the printing control apparatus 110 via a LAN controller 206 and the control cable 131. For example, the CPU 201 receives a command to set a conveyance speed that is directed to a conveyance unit of the image forming apparatus 101 via the LAN controller 206. Without being limited thereto, the image forming apparatus 101 can communicate various kinds of control information via the LAN controller 206 and the control cable 131.

The RAM 202 mainly functions as a main memory, a work area, and the like of the CPU 201.

The external storage device 211 is a storage device such as a hard disk drive (HDD) or an integrated circuit (IC) card. A disk controller (DKC) 208 controls access to the external storage device 211. The external storage device 211 is used to, for example, store an application program, font data, form data, and the like, and temporarily spool the print job and store a job for allowing the spooled job to be controlled from outside. Further, the external storage device 211 is used to, for example, save image data input from the scanner unit 213 and image data of the print job as box data to allow them to be referred to from the network or stored as box data planned to be printed.

The operation panel 105 is connected to the controller 200 via an operation panel interface 205, and the user can input various kinds of information from software keys or hardware keys.

A nonvolatile memory 209 stores therein various kinds of setting information set from the operation panel 105 or a terminal via the network.

A video interface 214 receives the image data from the printing control apparatus 110 via the image video cable 130. The image data is, for example, the rasterized image drawn by the printing control apparatus 110 based on the PDL data input to the printing control apparatus 110.

A sheet feeding interface 215 controls processing for feeding a sheet from the sheet feeding unit 401 provided to the image forming apparatus 101. Further, the sheet feeding interface 215 functions as a communication interface for establishing communication between the image forming apparatus 101 and the sheet feeding apparatus 102. The present embodiment will be described based on the following implementation. That is, the controller 200 of the image forming apparatus 101 receives an instruction to set the conveyance speed of a conveyance unit in the sheet feeding apparatus 102. Then, the controller 200 sets the conveyance speed of the conveyance unit to the sheet feeding apparatus 102 via the sheet feeding interface 215. The configuration is not limited thereto, and the present embodiment may be configured in such a manner that the sheet feeding apparatus 102 directly receives the instruction to set the conveyance speed of the conveyance unit and sets the conveyance speed.

A connection mechanism 216 is a connection mechanism for physically connecting the image forming apparatus 101 and the sheet feeding apparatus 102.

A post-processing apparatus interface 217 functions as a communication interface for establishing communication between the image forming apparatus 101 and the post-processing apparatus 103. The present embodiment will be described based on the following implementation. That is, the controller 200 of the image forming apparatus 101 receives an instruction to set the conveyance speed of a conveyance unit in the post-processing apparatus 103. Then, the controller 200 sets the conveyance speed of the conveyance unit to the post-processing apparatus 103 via the post-processing apparatus interface 217. The configuration is not limited thereto, and the present embodiment may be configured in such a manner that the post-processing apparatus 103 directly receives the instruction to set the conveyance speed of the conveyance unit and sets the conveyance speed.

A connection mechanism 218 is a connection mechanism for physically connecting the image forming apparatus 101 and the post-processing apparatus 103.

(Configuration of Printing Control Apparatus 110)

Figure 3:
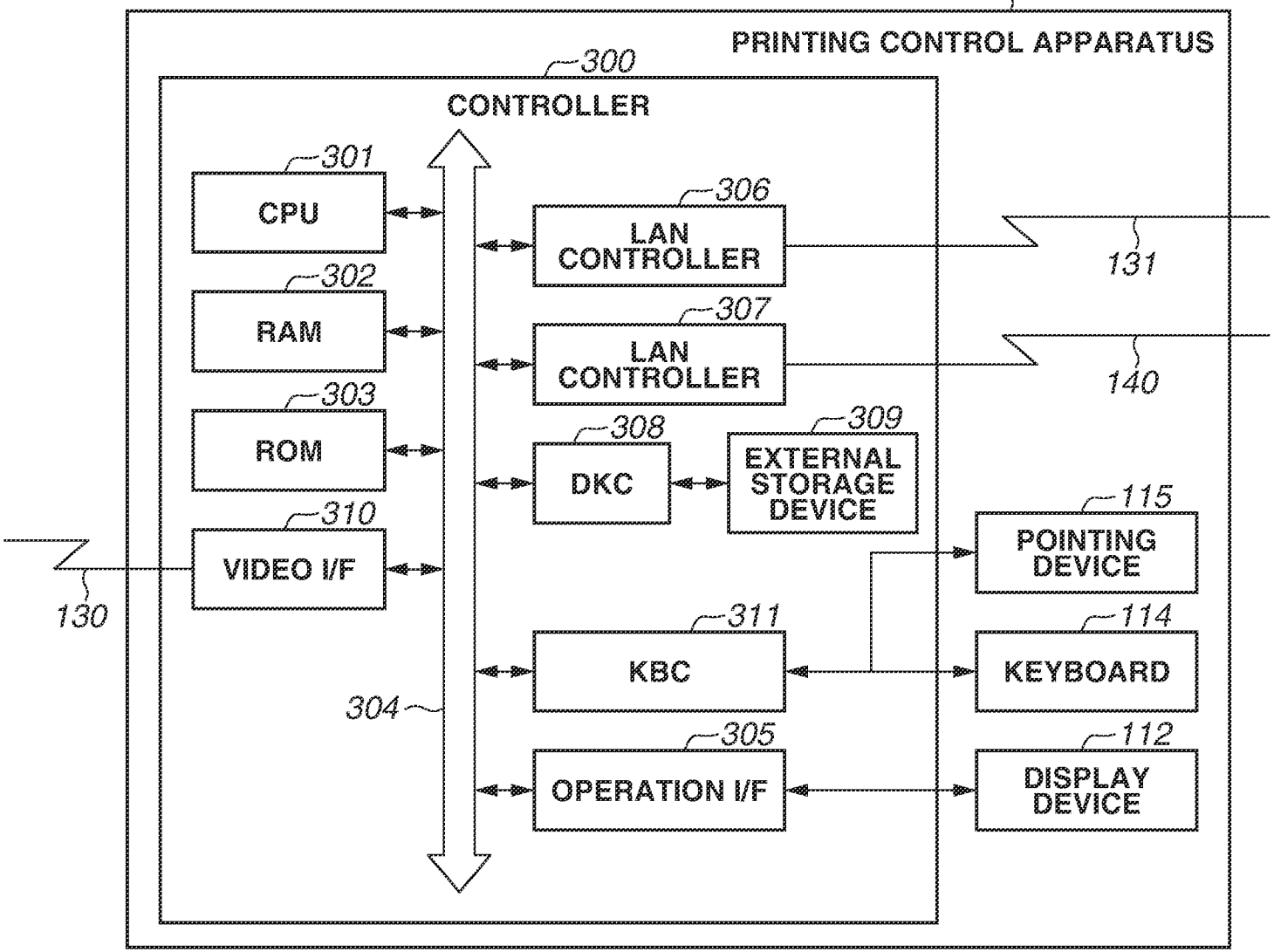
FIG. 3 is a block diagram illustrating the hardware configuration of a printing control apparatus 110 according to the first embodiment.

Next, the hardware configuration of the printing control apparatus 110 according to the present embodiment will be described with reference to FIG. 3.

A controller 300 includes a CPU 301, and the CPU 301 loads a control program stored in a ROM 303 or an external storage device 309 into a RAM 302. The CPU 301 comprehensively controls various kinds of devices connected to a system bus 304 by executing the program loaded in the RAM 302.

Further, the CPU 301 can communicate with the image forming apparatus 101 via a LAN controller 306 and the control cable 131. Further, a LAN controller 307 and the LAN 140 allow the CPU 301 to perform processing for communicating with the client computer 120 and the image forming apparatus 101 in the network via them.

The RAM 302 mainly functions as a main memory, a work area, and the like of the CPU 301. The external storage device 309 is formed using an HDD, an IC card, or the like. A disk controller (DKC) 308 controls access to the external storage device 309. The external storage device 309, for example, stores therein an application program, font data, form data, and the like, and temporarily spools the print job. Further, the external storage device 309 is used as a job storage area for saving the rasterized image generated by rasterizing the PDL data contained in the spooled job.

A video interface 310 transmits the rasterized image to the image forming apparatus 101 via the image video cable 130. A keyboard controller (KBC) 311 performs processing regarding an input of, for example, information from a keyboard 114 or a pointing device 115. An operation unit interface 305 controls the content to be displayed on the display unit 112. For example, an operation button with which the user inputs various kinds of information are displayed on the display unit 112. Further, a setting screen that will be described below with reference to FIG. 9 is displayed on the display unit 112.

(Sheet Conveyance Route in Image Forming System 100)

A sheet conveyance route in the image forming system 100 will be described with reference to FIG. 4.

An image forming unit 400 includes the sheet feeding units 401, development stations 404 to 407, a conveyance path 403, an intermediate transfer belt 408, and a transfer unit 409.

The sheet feeding units 401 contain various kinds of sheets (recording media). Each of the sheet feeding units 401 can separate one sheet alone that is placed on the top of the contained sheets, and convey it to the conveyance path 403. The sheet feeding units 401 may be sheet feeding decks of the image forming apparatus 101 or may be sheet feeding decks of the sheet feeding apparatus 102 mounted on the image forming apparatus 101.

The development stations 404 to 407 form toner images using respective colored toner of yellow (Y), magenta (M), cyan (C), and black (K) to form a color image. The toner images formed here are primarily transferred onto the intermediate transfer belt 408. The intermediate transfer belt 408 rotates in the clockwise direction in FIG. 4, and the toner images are transferred onto the sheet conveyed from the conveyance path 403 at the transfer unit 409. The sheet with the toner images transferred thereon is conveyed to a fixing unit 410.

The fixing unit 410 includes a first fixing unit 411, a second fixing unit 413, a conveyance path 412, a conveyance path 414, a conveyance path 415, a sheet reversing path 416, and a two-sided reversing path 417.

The first fixing unit 411 fixes the toner images transferred on the sheet to the sheet. The first fixing unit 411 includes a pressing roller and a heating roller. The sheet passes through between these rollers, by which the toner melted due to the heat of the heating roller is pressure-fixed to the sheet.

After passing through the fixing unit 411, the sheet passes through the conveyance path 412 and is conveyed to the conveyance path 415. If the toner is to be further melted and pressure-fixed for the fixing depending on the type of the sheet, the sheet is conveyed to the second fixing unit 413 using the conveyance path 414 and is subjected to additional melting and pressure-fixing of the toner. After that, the sheet passes through the conveyance path 414 and is conveyed to the conveyance path 415.

When an image formation mode is two-sided, the sheet is conveyed to the sheet reversing path 416 and is reversed, and, after that, is conveyed to the two-sided reversing path 417 and is subjected to the transfer of the image on the second side at the transfer unit 409.

Figure 4:
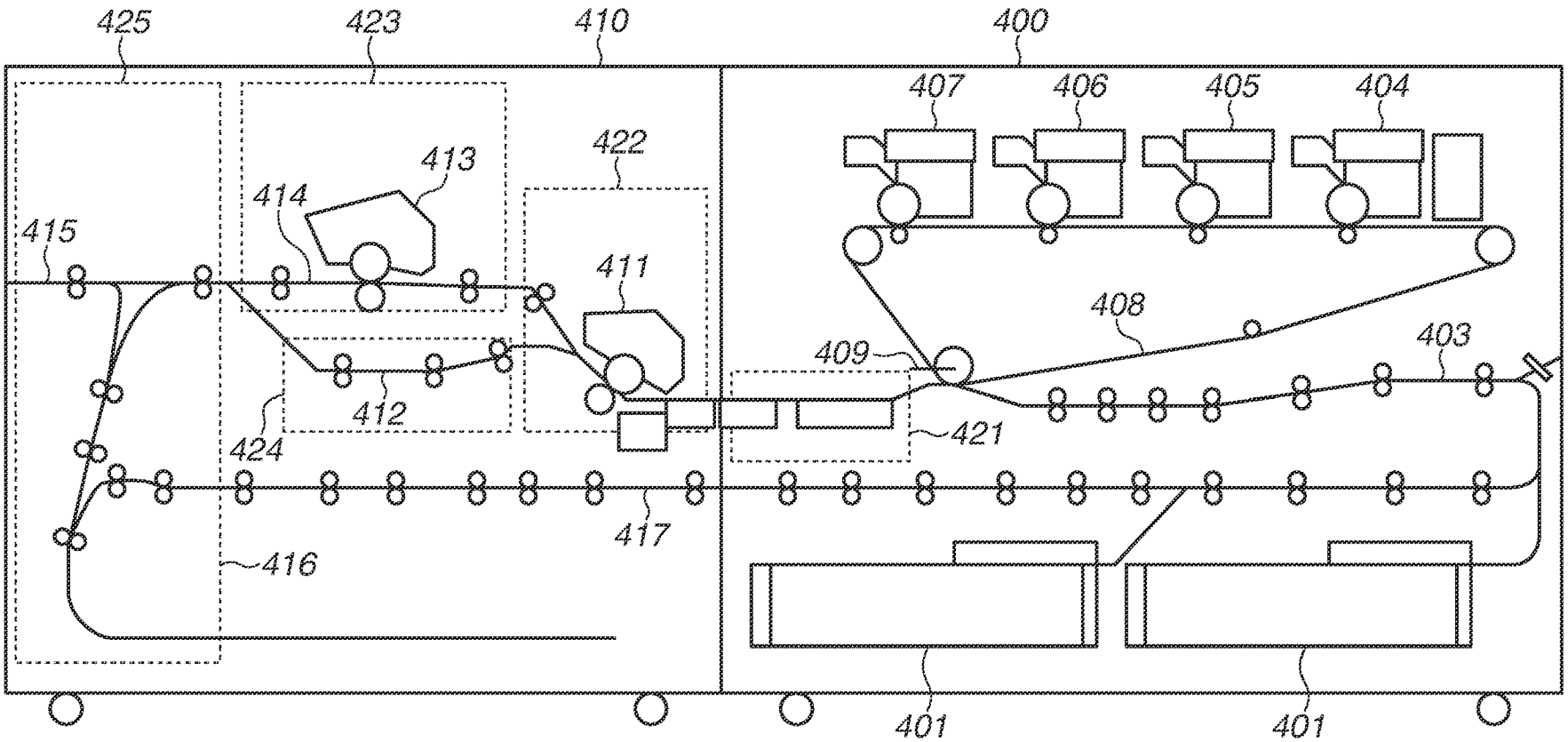
FIG. 4 illustrates sheet conveyance units in an image forming system 100 according to the first embodiment.

In the present embodiment, the conveyance speed can be individually set with respect to each of conveyance units 421 to 425 illustrated in FIG. 4. The conveyance units 421 to 425 each indicate, when the conveyance speed is set, a region to which the setting is applied.

The conveyance unit 421 is a conveyance mechanism in a conveyance region upstream of the first fixing unit 411. In the present embodiment, the direction corresponding to the source from which the sheet is conveyed in the conveyance route along which the sheet is conveyed will be referred to as an upstream side in the conveyance route. Then, the direction corresponding to the destination to which the sheet is conveyed in the conveyance route of the sheet will be referred to as a downstream side in the conveyance route. The conveyance unit 422 is a conveyance mechanism in a conveyance region containing the first fixing unit 411. The conveyance unit 423 is a conveyance mechanism in a conveyance region containing the second fixing unit 413. The conveyance unit 424 is a conveyance mechanism in a conveyance region containing the conveyance path 412. The conveyance unit 425 is a conveyance mechanism in a conveyance region containing the conveyance path 415 and the sheet reversing path 416.

The conveyance speed of a motor located in each of the conveyance units can be set by the user individually, as will be described below.

How to partition the conveyance units is not limited to the implementation illustrated in FIG. 4, and the conveyance units can be arbitrarily partitioned. Further, the present embodiment has been described based on an implementation in which the conveyance speed is set unit by unit for each of the conveyance units with respect to the conveyance route formed by the conveyance unit 421 and the conveyance units subsequent thereto in the implementation illustrated in FIG. 4, but is not limited thereto. A conveyance unit may also be set with respect a further upstream conveyance route. For example, a conveyance mechanism of the conveyance path 403, which conveys the sheet from the sheet feeding unit 401, may be set as a conveyance unit, and/or a conveyance mechanism for performing the transfer processing on the intermediate transfer belt 408 may be set as a conveyance unit.

(Setting of Conveyance Speed in Image Forming System 100 on Printing Control Apparatus 110)

A procedure for setting the transfer speed of each of the conveyance units in the image forming system 100 using a setting application installed in the printing control apparatus 110 will be described with reference to FIGS. 5A to 5D. This procedure will be described based on the implementation in which the setting application is installed in the printing control apparatus 110 in the present embodiment, but may be performed assuming that this setting application is installed in the client computer 120. In this case, the user can set the transfer speed of each of the conveyance units in the image forming system 100 from the setting application in the client computer 120.

Figure 5A:
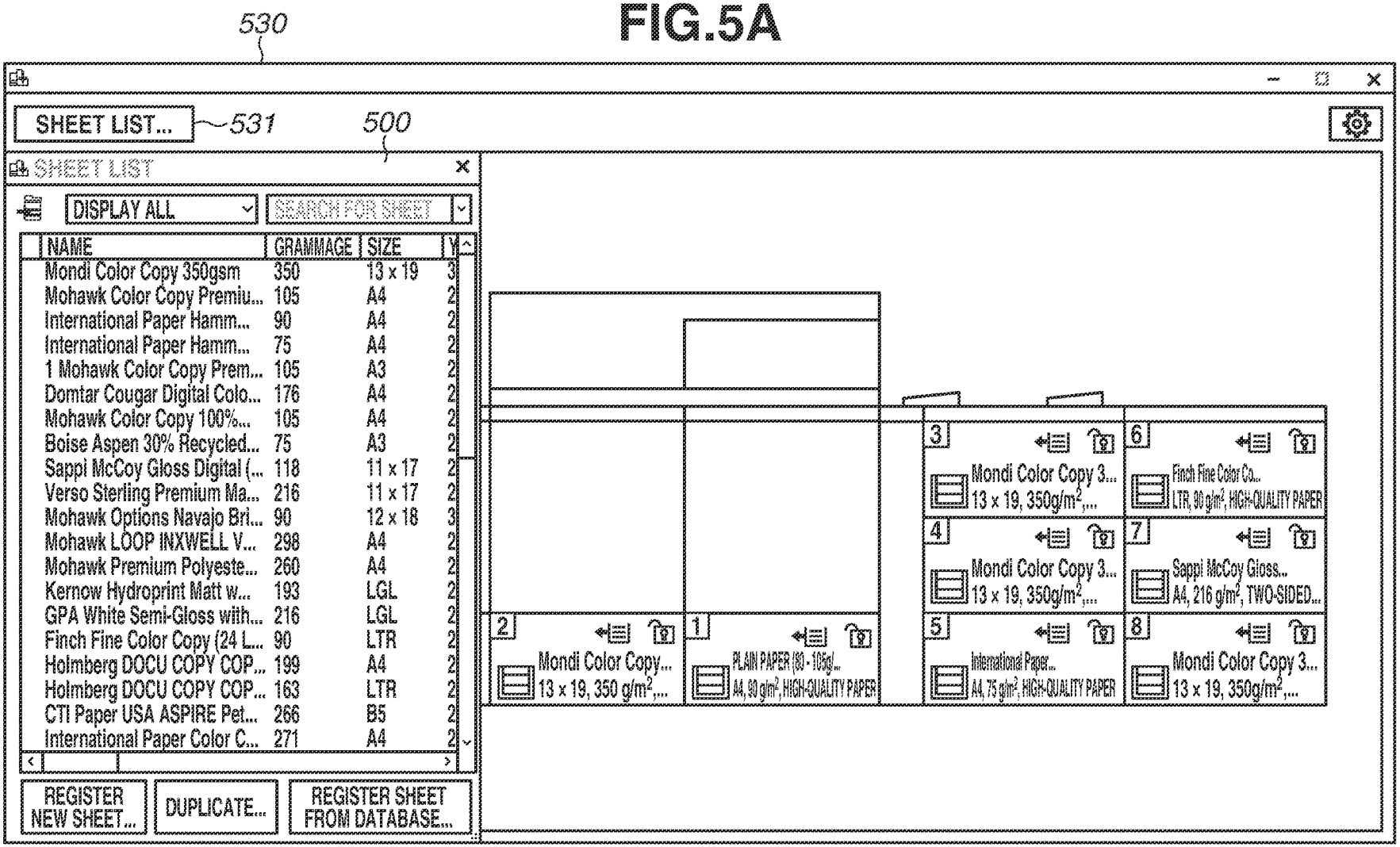
FIG. 5A illustrates a screen for setting the conveyance speed of a conveyance unit according to the first embodiment.
Figure 5B:
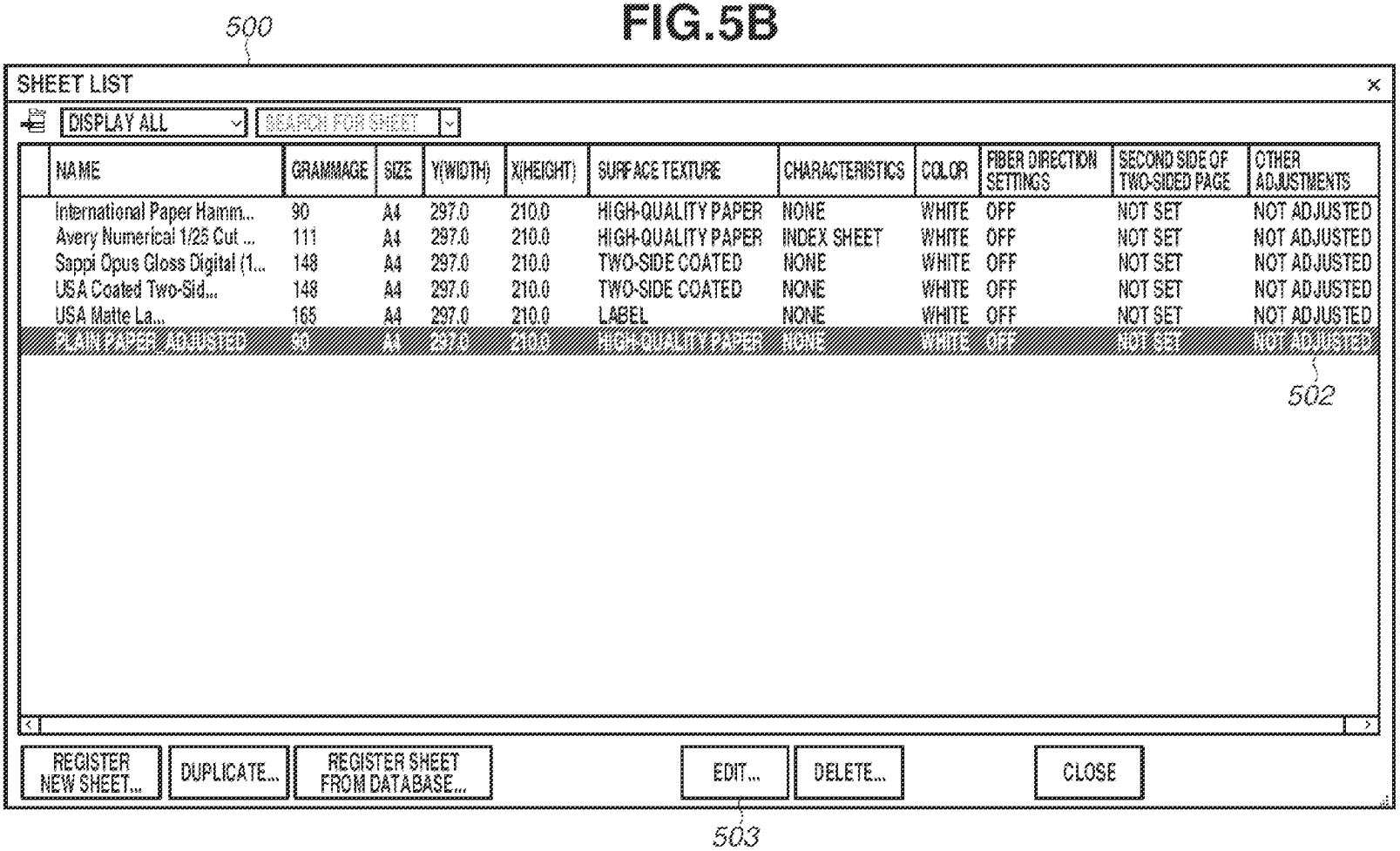
FIG. 5B illustrates a screen for setting the conveyance speed of the conveyance unit according to the first embodiment.

When the user operates the printing control apparatus 110 to start up the setting application, a sheet feeding setting screen 530 illustrated in FIG. 5A is displayed on the display unit 112. The type of the sheet contained in each of the sheet feeding units 401 in the image forming system 100 can be set on the sheet feeding setting screen 530. In the present embodiment, the current setting value set to the image forming system 100 is acquired with respect to each of setting items that will be described below according to the startup of the setting application. However, the timing and the content of the acquisition of the current setting value are not limited thereto. For example, the acquisition of the current setting value may be set in such a manner that, at the timing when a conveyance setting screen 520, which will be described below, is displayed, the current setting values are acquired with respect to at least one of the conveyance unit for which the setting value is set on this conveyance setting screen 520 or a conveyance unit located downstream thereof. A table 700 illustrated in FIG. 7 is updated based on the setting value acquired from the image forming system 100 in this manner.

When the user selects a sheet list display button 531 displayed on the sheet feeding setting screen 530, a sheet list 500 is displayed. The sheet list 500 indicates the type of a sheet settable in each of the sheet feeding units 401. This sheet list 500 may be prepared by being stored in the external storage device 309 of the printing control apparatus 110 in advance or may be prepared in such a manner that the printing control apparatus 110 acquires the sheet list 500 from the image forming system 100. The timing of acquiring the sheet list 500 can be set to, for example, when the printing control apparatus 110 is started up, when the setting application is started up, or the timing at which the printing control apparatus 110 is instructed to display the sheet list 500, but is not especially limited.

Subsequently, when the user selects one sheet type from the sheet list 500 and selects an editing button 503, an editing screen 510 is displayed. In the example illustrated in FIG. 5B, when the user selects "plain paper_adjusted" 502 in the sheet list 500 and presses the editing button 503, this causes the display of the editing screen 510, which is used to configure the settings when the printing is carried out using "plain paper_adjusted" 502.

A sheet name field 511, a grammage field, and a selection screen 513 are contained in the editing screen 510. The user can select the setting item that the user wants to set from the selection screen 513. With respect to the setting item selected by the user, the set content is applied when the print data is printed on the sheet displayed in the sheet name field 511. In this manner, according to the present embodiment, the user can configure the print settings individually for each sheet type. In the present embodiment, the user can configure the setting with respect to the conveyance speed of the conveyance unit for each sheet type.

A list of setting items corresponding to parameters for carrying out the printing using the selected sheet is displayed on the selection screen 513. These setting items include the adjustment of the toner amount, the adjustment of the transfer voltage, the adjustment of the image printing position on the sheet, the adjustment of the margin position, the adjustment of the sheet conveyance speed, the setting of the post-processing (punching processing, stapling processing, and folding processing), and the like.

In the embodiment illustrated in FIG. 5C, an "adjustment of the sheet conveyance of the conveyance unit before the fixing" 514 is a setting item for setting the sheet conveyance speed of the conveyance unit 421 described with reference to FIG. 4. Further, an "adjustment of the sheet conveyance of the first fixing unit" is a setting item for setting the conveyance speed of the conveyance unit 422 described with reference to FIG. 4. Further, an "adjustment of the sheet conveyance of the second fixing unit" is a setting item for setting the conveyance speed of the conveyance unit 423 described with reference to FIG. 4. Further, an "adjustment of the sheet conveyance of the bypass unit" is a setting item for setting the conveyance speed of the conveyance unit 424 described with reference to FIG. 4. Further, an "adjustment of the sheet conveyance of the reversing/sheet discharge unit" is a setting item for setting the conveyance speed of the conveyance unit 425 described with reference to FIG. 4.

When the user selects a desired setting item from the selection screen 513 and selects an editing button 512, the screen transitions to a conveyance setting screen 520. The name of the setting item to be set from now is displayed in a title 521. In other words, the name of the setting item selected on the selection screen 513 is displayed.

An input portion 522 is an input field for inputting an adjustment value of the conveyance speed. This adjustment value is a value indicating how much the setting value is increased or reduced based on the setting value currently set to the image forming system 100. This adjustment value indicates a change amount by which the setting value of the conveyance speed of the conveyance unit is changed. For example, if "6" is input to the input portion 522, a value resulting from increasing the setting value currently set to the image forming system 100 by 6 is set as a new setting value. The present embodiment is configured in such a manner that an incremental/decremental value (a relative value) relative to the currently set value is input to the input portion 522, but is not limited thereto. The present embodiment may be configured in such a manner that a setting value (an absolute value) to be newly made is input to the input portion 522. The CPU 301 functions as a reception unit that receives an instruction to set the conveyance speed of the conveyance unit via the conveyance setting screen 520.

The adjustment value displayed in the input portion 522 can be changed by pressing a minus button 523 or a plus button 524. When the minus button 523 is pressed, −1 is applied to the numerical value displayed in the input portion 522. When the plus button 524 is pressed, +1 is applied to the numerical value displayed in the input portion 522. When the numerical value is changed by "1", the conveyance speed of the motor belonging to the unit is changed by a predetermined speed. The conveyance setting screen 520 may be configured to allow the user to directly input the adjustment value to the input portion 522 using the pointing device 115 or the keyboard 114.

Then, when the setting instruction directed to the conveyance speed of the conveyance unit 421 targeted for the setting (the sheet conveyance of the conveyance unit before the fixing) is entered by pressing an OK button 527, the conveyance speed of the conveyance unit 421 is set to the image forming system 100 based on this instruction. Along therewith, the conveyance speed of the conveyance unit located downstream of the conveyance unit 421 selected by the user is set to the image forming system 100 based on the setting instruction. The conveyance units located downstream are the conveyance unit 422 (the sheet conveyance of the first fixing unit), the conveyance unit 423 (the sheet conveyance of the second fixing unit), the conveyance unit 424 (the sheet conveyance of the bypass unit), and the conveyance unit 425 (the sheet conveyance of the reversing/sheet discharge unit) in the embodiment illustrated in FIG. 4.

According to such a configuration, the conveyance speed of the conveyance unit located on the downstream side in the conveyance route is automatically adjusted according to the issue of the instruction to adjust the conveyance speed of the conveyance unit located on the upstream side in the conveyance route.

Therefore, the conveyance speed can be kept consistent between the conveyance unit for which the conveyance speed is set by the user and the conveyance unit on the downstream side thereof even without the user being conscious of it. Further, the user can save time and effort required to set the conveyance speed of the downstream unit when adjusting the conveyance speed of one conveyance unit.

An application range 526 displayed on the conveyance setting screen 520 displays a list of the other setting items (the other conveyance units) corresponding to the settings changed according to the input of the adjustment value to the input portion 522. The application range 526 is information indicating that the conveyance speed of the downstream conveyance unit is set based on the instruction to set the conveyance speed of the selected conveyance unit. In the embodiment illustrated in FIG. 5D, the application range 526 indicates that the adjustment value input to the input portion 522 is also applied to the adjustment of the sheet conveyance of the first fixing unit, the adjustment of the sheet conveyance of the second fixing unit, the adjustment of the sheet conveyance of the bypass unit, and the adjustment of the sheet conveyance of the reversing/sheet discharge unit.

When the OK button 527 is pressed, the adjustment value input to the input portion 522 is applied to the image forming apparatus 101. The contents displayed in the application range 526 and the method for determining the application to the other setting items will be described below with reference to a flowchart illustrated in FIG. 6. The conveyance unit to which the adjustment value input to the input portion 522 is applied is identified by the CPU 301 in steps S607 and S608 illustrated in FIG. 6. The CPU 301 controls the display to display the name of the setting item corresponding to the identified conveyance unit in the application range 526.

When a cancel button 528 is pressed, the conveyance setting screen 520 is closed without the adjustment value input to the input portion 522 being applied to the image forming apparatus 101. The conveyance setting screen 520 has been described citing the adjustment of the sheet conveyance of the conveyance unit before the fixing 514 as an example, but a similar screen is also displayed when another setting item is set.

(Flow of Setting Conveyance Speed)

Figure 5D:
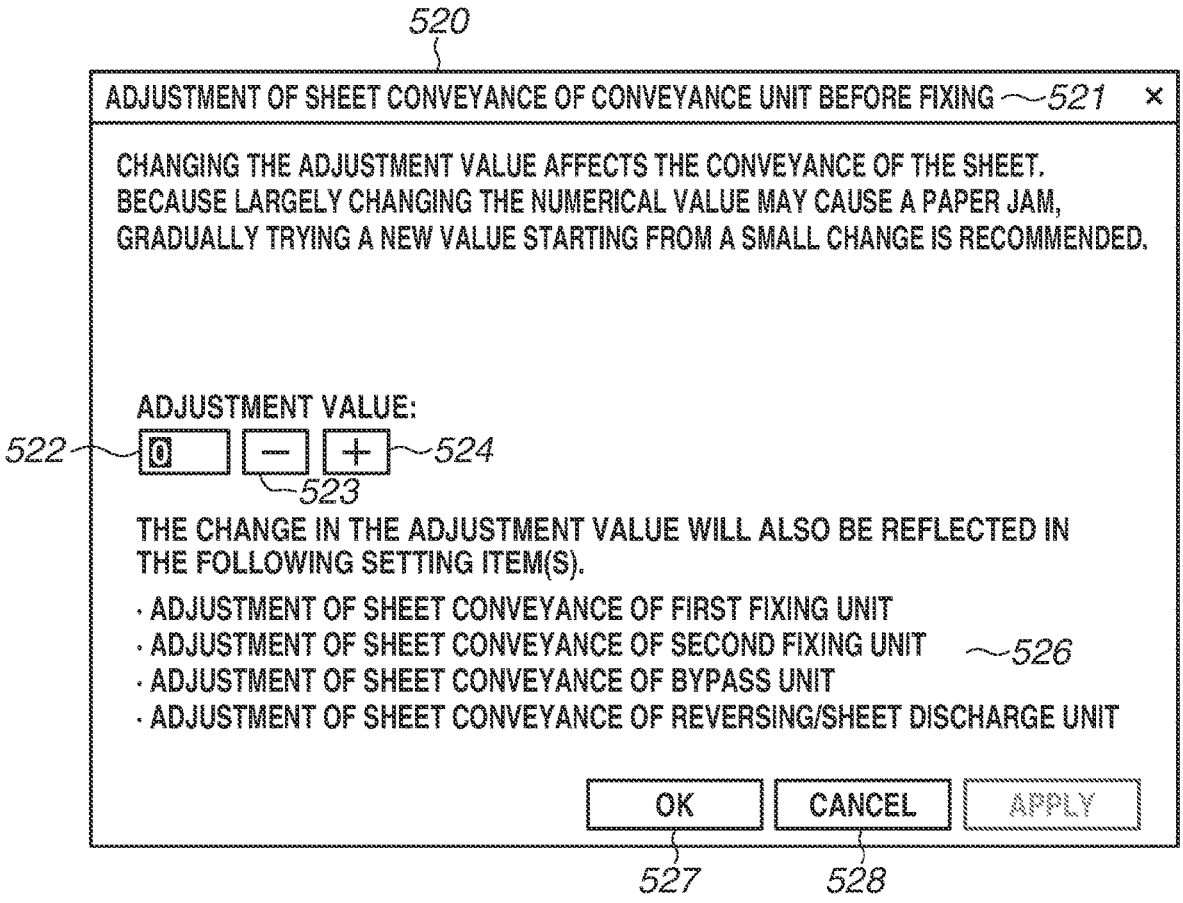
FIG. 5D illustrates a screen for setting the conveyance speed of the conveyance unit according to the first embodiment.
Figure 6:
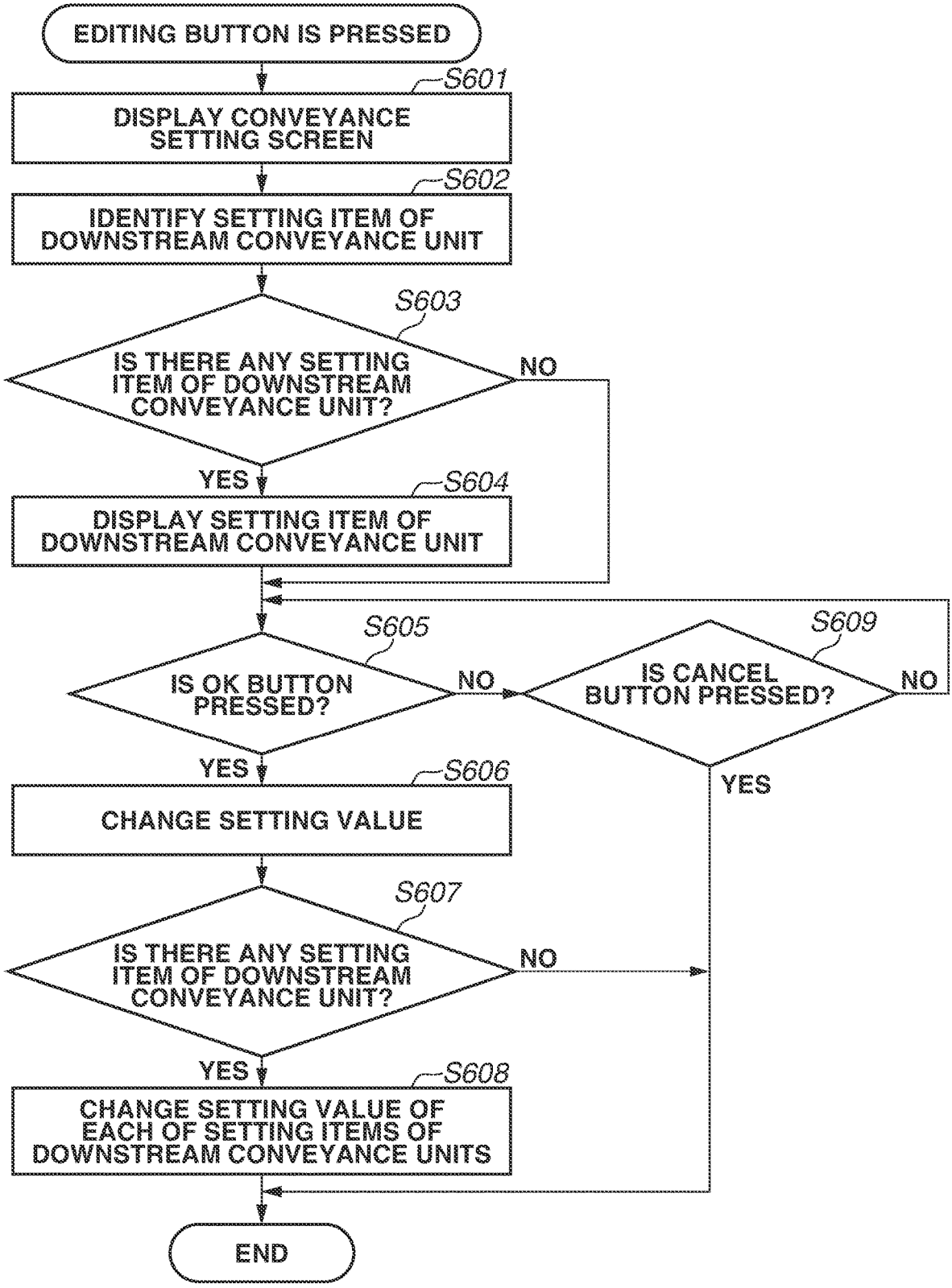
FIG. 6 is a flowchart illustrating a flow of processing for setting the conveyance speed of the conveyance unit according to the first embodiment.

The processing for setting the conveyance speed that is performed via the conveyance setting screen 520, which has been described with reference to FIG. 5D, will be described with reference to the flowchart of FIG. 6. The processing illustrated in the flowchart of FIG. 6 is achieved by the CPU 301 executing the above-described program loaded in the RAM 302. In the present embodiment, the flow illustrated in FIG. 6 is started when the editing button 512 is selected after the setting item is selected on the editing screen 510 illustrated in FIG. 5C.

In step S601, the CPU 301 displays the conveyance setting screen 520. The CPU 301 acquires the setting item selected on the selection screen 513, and displays it in the title 521.

In step S602, the CPU 301 identifies the setting item of the conveyance unit present downstream of the conveyance unit of the setting item selected by the user in the conveyance path by referring to the table 700 illustrated in FIG. 7. The table 700 illustrated in FIG. 7 may be prepared by being stored in the external storage device 309 of the printing control apparatus 110 or may be prepared by being stored in the external storage device 211 of the image forming apparatus 101.

In FIG. 7, a setting item column 701 indicate the name of the setting item. A conveyance order column 702 is an item to which a larger integer is assigned thereto as the unit corresponding to the setting item is located more downstream in the conveyance path.

The adjustment of the sheet conveyance of the conveyance unit before the fixing is a setting item corresponding to the conveyance unit 421, and, "1", which indicates that this setting item corresponds to the most upstream unit in the conveyance path, is assigned thereto. The adjustment of the sheet conveyance of the first fixing unit is a setting item corresponding to the conveyance unit 422 illustrated in FIG. 4, and, "2", which indicates that this setting item corresponds to the second unit from the upstream side in the conveyance path, is assigned thereto. The adjustment of the sheet conveyance of the second fixing unit is a setting item corresponding to the conveyance unit 423, and, "3", which indicates that this setting item corresponds to the third unit from the upstream side in the conveyance path, is assigned thereto. The adjustment of the sheet conveyance of the bypass unit is a setting item corresponding to the conveyance unit 424, and, "4", which indicates that this setting item corresponds to the fourth unit from the upstream side in the conveyance path, is assigned thereto. The adjustment of the sheet conveyance of the reversing/sheet discharge unit is a setting item corresponding to the conveyance unit 425, and, "5", which indicates that this setting item corresponds to the fifth unit from the upstream side in the conveyance path, is assigned thereto.

A lower limit value column 703 indicates a lower limit value of the setting value settable to the setting item. An upper limit value column 704 indicates an upper limit value of the setting value settable to the setting item.

A setting value column 705 indicates the setting value currently set to the setting item. The CPU 301 identifies the setting item of the conveyance unit present downstream of the conveyance unit of the selected setting item by referring to the above-described table 700 and comparing the selected setting item column 701 with the conveyance order column 702.

For example, if the "adjustment of the sheet conveyance of the conveyance unit before the fixing" (the conveyance unit 421) is selected by the user, the setting item of the conveyance unit located downstream thereof is identified in the following manner. The CPU 301 identifies the setting item of the conveyance unit having a larger numerical value assigned in the conveyance order thereof than the conveyance order "1" associated with the "adjustment of the sheet conveyance of the conveyance unit before the fixing" (the conveyance unit 421), by using the table 700. The CPU 301 identifies the "adjustment of the sheet conveyance of the first fixing unit" (the conveyance unit 422), the "adjustment of the sheet conveyance of the second fixing unit" (the conveyance unit 423), the "adjustment of the sheet conveyance of the bypass unit" (the conveyance unit 424), and the "adjustment of the sheet conveyance of the reversing/sheet discharge unit" (the conveyance unit 425).

In step S603, the CPU 301 determines whether there is any setting item of the downstream conveyance unit acquired in step S602. If there is a downstream setting item (YES in step S603), the processing proceeds to step S604. If there is no setting item of the downstream conveyance unit (NO in step S603), the processing proceeds to step S605.

In step S604, the CPU 301 displays the setting item of the downstream conveyance unit acquired in step S602 in the application range 526. In the embodiment illustrated in FIG. 5D, the CPU 301 displays the "adjustment of the sheet conveyance of the first fixing unit", the "adjustment of the sheet conveyance of the second fixing unit", the "adjustment of the sheet conveyance of the bypass unit", and the "adjustment of the sheet conveyance of the reversing/sheet discharge unit", each of which is the setting item of the downstream conveyance unit acquired in step S602.

In step S605, the CPU 301 determines whether the OK button 527 is pressed. If the OK button 527 is pressed (YES in step S605), the processing proceeds to step S606. If the OK button 527 is not pressed (NO in step S605), the processing proceeds to step S609.

In step S609, the CPU 301 determines whether the cancel button 528 is pressed. If the cancel button 528 is pressed (YES in step S609), the processing of the present flowchart ends. If the cancel button 528 is not pressed (NO in step S609), the processing returns to step S605 and the CPU 301 waits until the OK button 527 or the cancel button 528 is pressed.

On the other hand, in step S606, the CPU 301 acquires the numerical value input to the input portion 522, and updates the setting value of the image forming apparatus 101. For example, if "6" is input to the input portion 522 as the adjustment value, the CPU 301 adds the adjustment value "6" to the setting value written in the setting value column 705 in the table 700. For example, if the current setting value is "−5", the CPU 301 adds the adjustment value "6" thereto, thereby acquiring a new setting value "+1". The setting value in the setting value column 705 is updated with the new setting value acquired in this manner with respect to the adjustment of the sheet conveyance of the conveyance unit before the fixing.

In step S607, the CPU 301 determines whether there is any setting item of the downstream conveyance unit acquired in step S602. If there is a setting item of the downstream conveyance unit (YES in step S607), the processing proceeds to step S608. If there is no setting item of the downstream conveyance unit (NO in step S607), the processing of the present flowchart ends.

In step S608, the CPU 301 also applies the adjustment value input to the input portion 522 to the setting value of each of the setting items of the downstream conveyance units identified in step S602. For example, if the adjustment value "6" is input to the input portion 522, the CPU 301 also changes the setting values with respect to the setting items "adjustment of the sheet conveyance of the first fixing unit", "adjustment of the sheet conveyance of the second fixing unit", "adjustment of the sheet conveyance of the bypass unit", and "adjustment of the sheet conveyance of the reversing/sheet discharge unit".

More specifically, if the current setting value is "0" with respect to the "adjustment of the sheet conveyance of the first fixing unit", the CPU 301 adds the adjustment value "6" thereto to acquire "+6" as the new setting value. Further, if the current setting value is "−10" with respect to the "adjustment of the sheet conveyance of the second fixing unit", the CPU 301 adds the adjustment value "6" thereto to acquire "−4" as the new setting value. Further, if the current setting value is "+30" with respect to the "adjustment of the sheet conveyance of the bypass unit", the CPU 301 adds the adjustment value "6" thereto to acquire "+36" as the new setting value. Further, if the current setting value is "+15" with respect to the "adjustment of the sheet conveyance of the reversing/sheet discharge unit", the CPU 301 adds the adjustment value "6" thereto to acquire "+21" as the new setting value.

In the present embodiment, the difference between the setting value before the user sets it and the setting value after the user sets it (the adjustment value) is acquired with respect to the setting item of the conveyance unit specified by the user. Then, the setting value of the conveyance unit located downstream is updated by adding this adjustment value to the setting value of the conveyance unit located downstream of the conveyance unit selected by the user in the conveyance route. The method for updating the setting value of the conveyance unit located downstream is not limited thereto, and the setting value of the conveyance unit located downstream may be updated in such a manner that the same value is set between the setting value set to the conveyance unit specified by the user and the setting value of the conveyance unit located downstream thereof in the conveyance route. In other words, the present embodiment may be configured to update the setting value of the conveyance unit located downstream in the conveyance route using the setting value as the absolute value instead of using the relative value like the above-described adjustment value.

In this manner, the CPU 301 ends the processing of the present flowchart when completing the update of the setting of the conveyance speed with respect to the conveyance unit located downstream of the conveyance unit corresponding to the setting item selected by the user.

The content of the updated setting value is transmitted from the printing control apparatus 110 to the image forming system 100. The image forming system 100 applies the setting content received from the printing control apparatus 110 to the setting of each of the conveyance units.

According to the above-described configuration, the conveyance speed of the conveyance unit located on the downstream side in the conveyance route (a second conveyance unit) is automatically adjusted according to the issue of the instruction to adjust the conveyance speed of the conveyance unit located on the upstream side in the conveyance route (a first conveyance unit).

Therefore, the conveyance speed can be kept consistent between the conveyance unit for which the conveyance speed is set by the user and the conveyance unit on the downstream side thereof even without the user being conscious of it. Further, the user can save time and effort required to set the conveyance speed of the downstream unit when adjusting the conveyance speed of one conveyance unit.

Further, according to the processing for updating the setting value, which has been described with reference to FIG. 6, the speed of a conveyance unit located upstream of the conveyance unit for which the user issues the instruction to update the setting value in the conveyance route is not updated along with the update of the setting value by the user.

For example, in FIG. 4, when the user issues the instruction to update the setting value of the conveyance unit 422, the setting values of the conveyance unit 423, the conveyance unit 424, and the conveyance unit 425 located downstream thereof are automatically updated based on this instruction. On the other hand, the setting value of the conveyance speed of the conveyance unit 421 located upstream of the conveyance unit 422, for which the instruction to update the setting value is issued, in the conveyance route of the sheet is not changed based on the user's setting instruction directed to the conveyance unit 422.

Therefore, the user can adjust the conveyance speed, targeting only a part of the conveyance units among the plurality of conveyance units.

For example, in FIG. 4, in a case where the conveyance speed is inconsistent between the conveyance units 421 and 422 and, for example, the sheet is undesirably wrinkled, the setting of the conveyance speed of the conveyance unit 422 can be adjusted while the setting of the conveyance speed of the conveyance unit 421 is maintained. Further, if the consistency is already established among the conveyance speeds of the conveyance unit 422 and the conveyance units subsequent thereto from the conveyance unit 423 to the conveyance unit 425, the consistency established among the conveyance speeds can be maintained because their respective conveyance speeds are individually changed by the same value.

For example, even in a case where the actual conveyance speed is unintentionally changed relative to the setting value of the conveyance unit 421 due to, for example, the deterioration of the conveyance unit 421 over time, the consistency can be achieved among the conveyance speeds of all the conveyance units. More specifically, the consistency can be achieved among the conveyance speeds of all the conveyance units by collectively adjusting the conveyance speeds of the conveyance unit 422 and the conveyance units subsequent thereto in the above-described manner.

On the other hand, the method that collectively sets the same setting value to all the conveyance units, like the conventional technique, is unable to sufficiently address the inconsistency among the conveyance speeds in the entire conveyance route in the case where the actual conveyance speed is unintentionally changed relative to the setting value with respect to only one unit due to the deterioration over time or the like.

According to the present embodiment, even in such a case, the conveyance speed can be set with respect to the individual conveyance unit among the plurality of conveyance units. Therefore, even in a case like the above-described embodiment, the inconsistency can be sufficiently addressed among the conveyance speeds in the entire conveyance route.

The present embodiment may be configured to include a setting that allows the user to switch whether to enable or disable the function of automatically adjusting the setting value of the conveyance speed of the downstream conveyance unit based on the adjustment content of the conveyance speed of the upstream conveyance unit.

Second Embodiment

The first embodiment has been described regarding an implementation in which the conveyance speed in the image forming system 100 is set from the application installed in the printing control apparatus 110 or the client computer 120. The present embodiment will be described regarding an implementation in which the downstream conveyance unit is set based on the fact that the conveyance speed of one conveyance unit is set when the conveyance speed in the image forming system 100 is set on the image forming apparatus 101 included in the image forming system 100.

The configuration of a system according to the present embodiment is similar to the configuration described with reference to FIGS. 1 to 4 in the first embodiment, and therefore the description thereof will be omitted here.

Figures 8A, 8B:
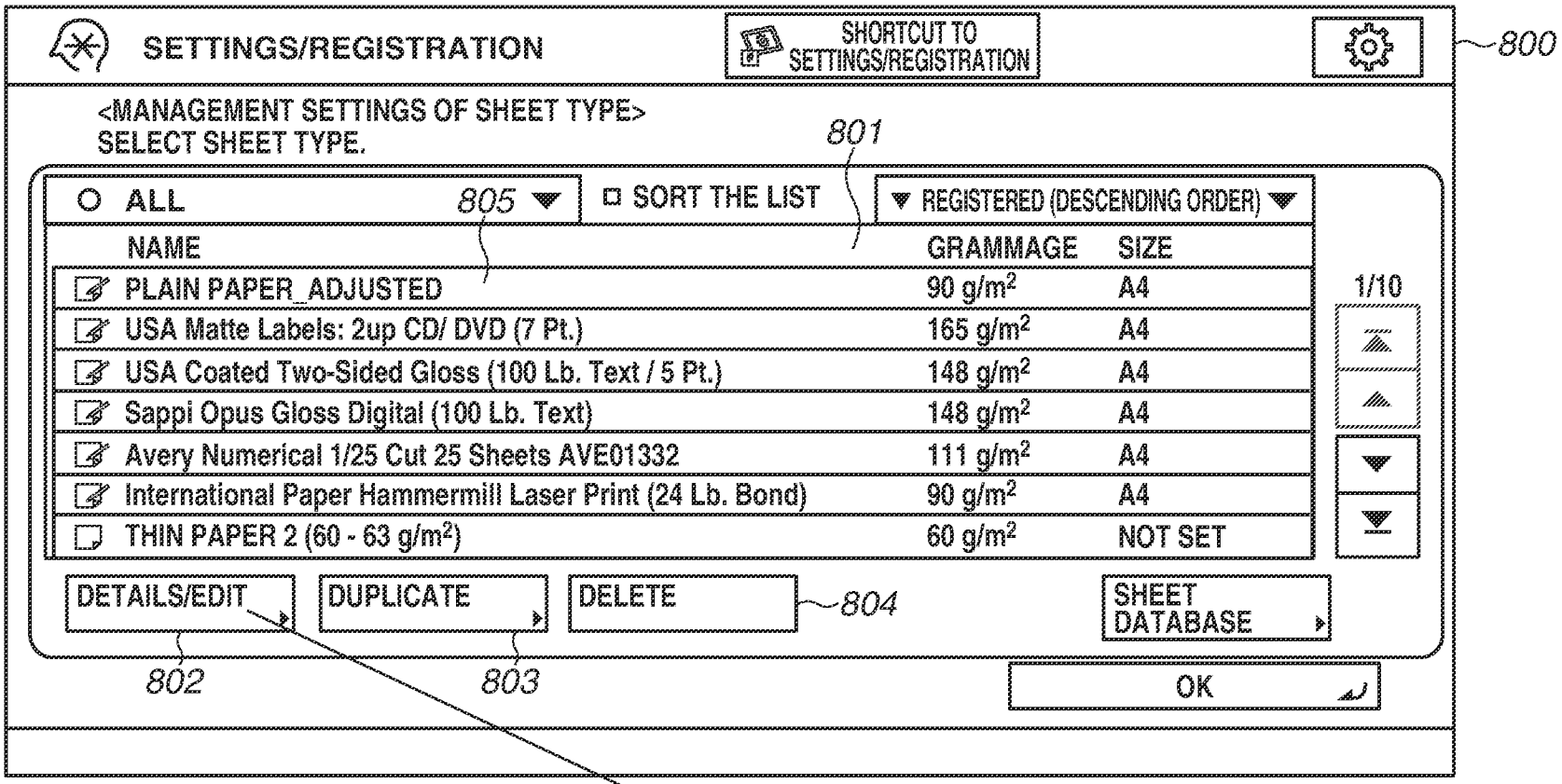
FIGS. 8A, 8B, and 8C illustrate a screen for setting the conveyance speed of the conveyance unit according to a second embodiment.
Figure 8B:
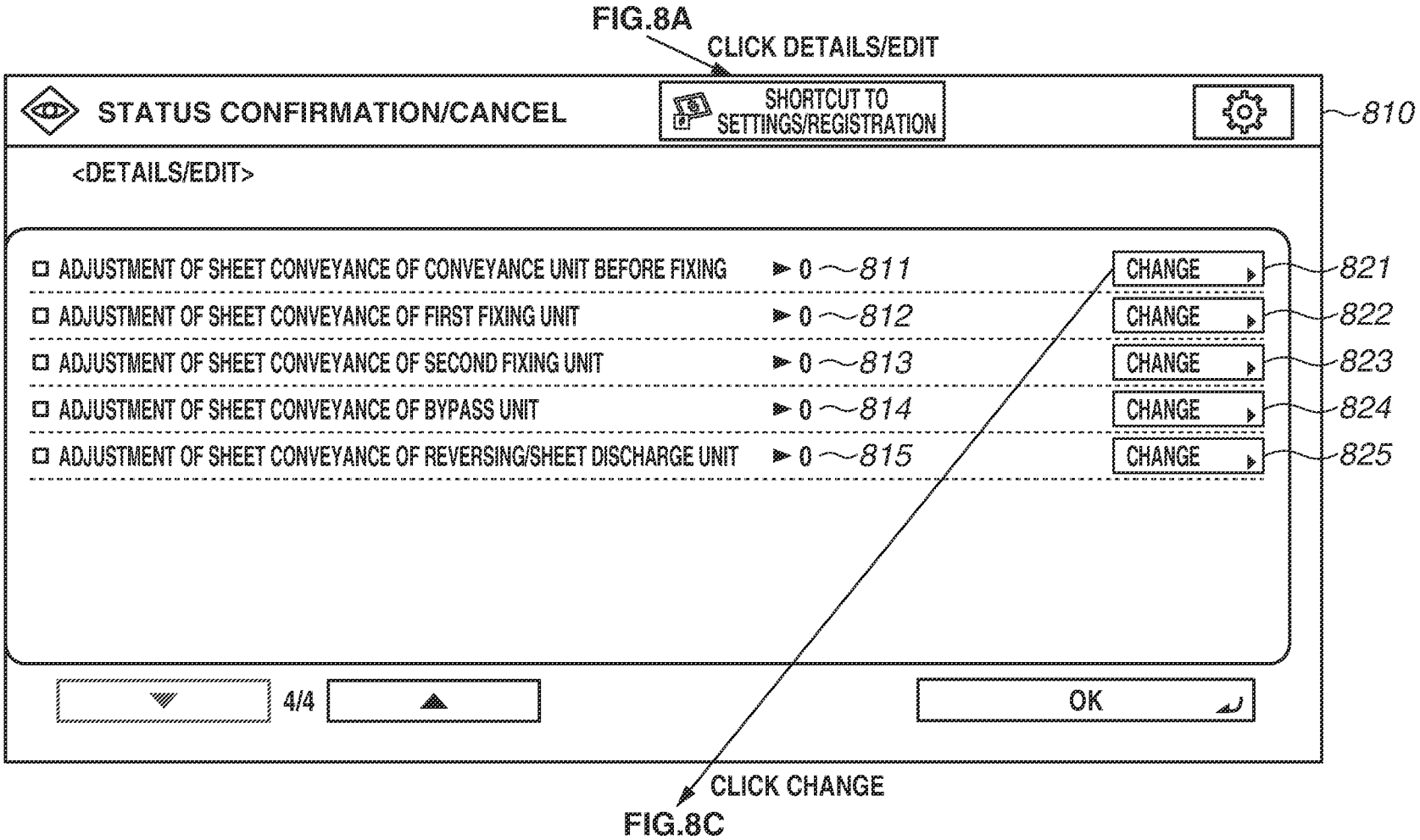
Figure 8C:
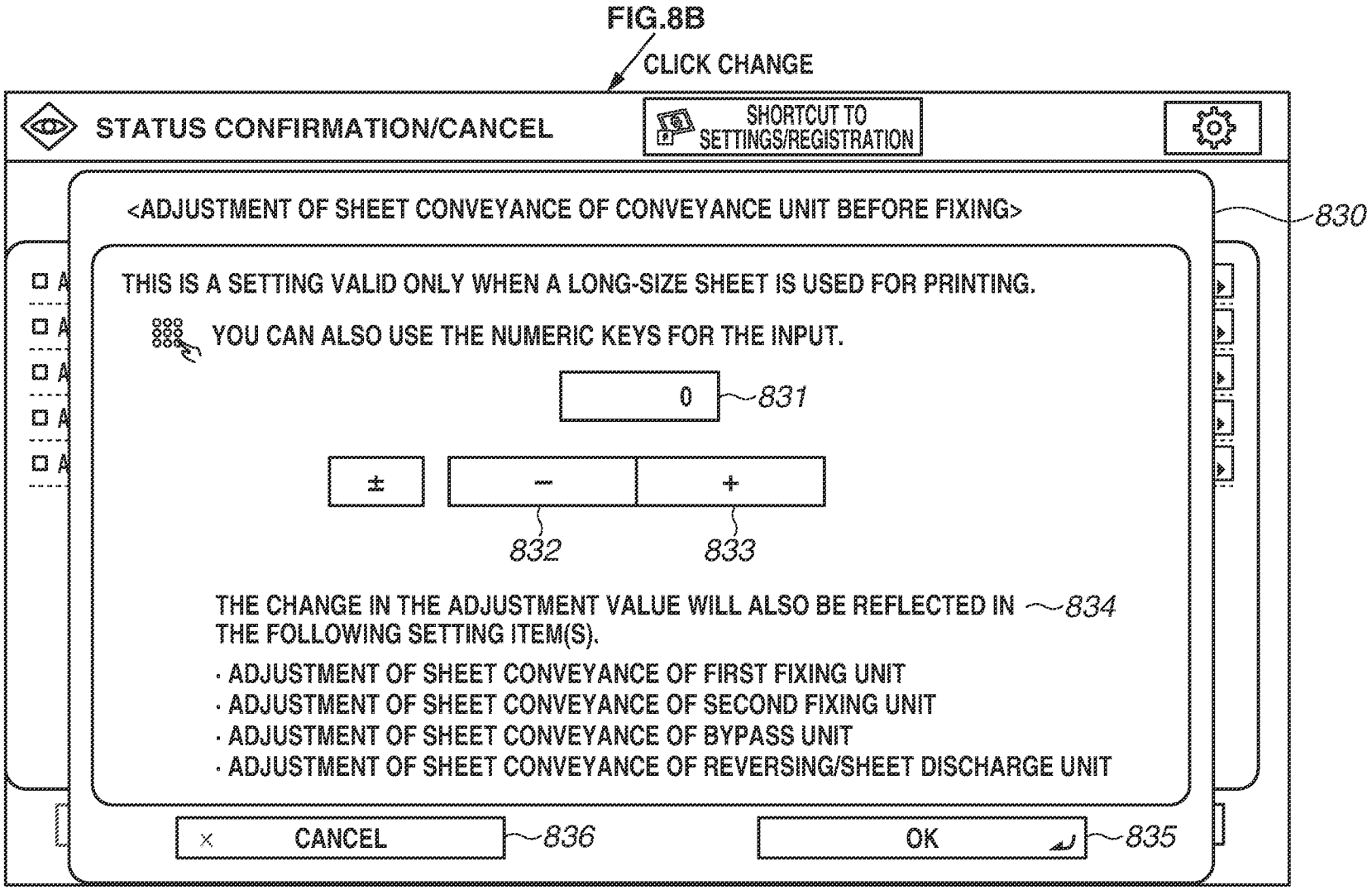

An embodiment in which the conveyance speed of the conveyance unit in the image forming system 100 is set from a setting screen displayed on the operation panel 105 of the image forming apparatus 101 will be described with reference to FIGS. 8A to 8C. The present embodiment will be described based on the implementation in which the setting operation is performed via the operation panel 105 of the image forming apparatus 101, but is not limited thereto. The present embodiment may be configured in such a manner that the operation screen of the image forming apparatus 101 is displayed on the display unit of the printing control apparatus 110 or the client computer 120, and the setting operation is performed via this operation screen on the printing control apparatus 110 or the client computer 120.

When the user operates the operation panel 105 and instructs the image forming apparatus 101 to display a setting screen 800 for performing the settings regarding the sheet, a sheet list 801 is displayed.

The name, the grammage, and the size set to each sheet type are displayed in the sheet list 801. FIGS. 8A to 8C illustrate an embodiment in which "plain paper_adjusted" 805 is selected by the user. The user can select the sheet type by, for example, operating the operation panel 105.

A details/editing button 802 is a button for displaying an editing screen 810 on which the setting items of the selected sheet type are selected. A duplication button 803 is a button for duplicating the selected sheet type and adding it to the list. A deletion button 804 is a button for deleting the selected sheet type from the list.

When the sheet type 805 is selected and the details/editing button 802 is pressed, the editing screen 810 for selecting the setting items is displayed. A list of setting items regarding the sheet type selected in the sheet list 801 is displayed on the editing screen 810. Five items 811 to 815 are displayed as the setting items in the embodiment illustrated in FIG. 8B. Screens for changing the setting contents of 811 to 815 can be displayed by selecting change buttons 821 to 825, respectively.

An adjustment of the sheet conveyance of the conveyance unit before the fixing 811 is the setting item with respect to the conveyance speed of the conveyance unit 421 in the image forming system 100. An adjustment of the sheet conveyance of the first fixing unit 812 is the setting item with respect to the conveyance speed of the conveyance unit 422 in the image forming system 100. An adjustment of the sheet conveyance of the second fixing unit 813 is the setting item with respect to the conveyance speed of the conveyance unit 423 in the image forming system 100. An adjustment of the sheet conveyance of the bypass unit 814 is the setting item with respect to the conveyance speed of the conveyance unit 424 in the image forming system 100. An adjustment of the sheet conveyance of the reversing/sheet discharge unit 815 is the setting item with respect to the conveyance speed of the conveyance unit 425 in the image forming system 100.

When the change button 821 corresponding to the adjustment of the sheet conveyance of the conveyance unit before the fixing 811 is pressed, a conveyance setting screen 830 is displayed.

An input portion 831 is an input field for inputting the adjustment value of the conveyance speed. This adjustment value is a value indicating how much the setting value is increased or reduced based on the setting value currently set to the image forming system 100. For example, if "6" is input to the input portion 831, a value resulting from increasing the setting value currently set to the image forming system 100 by 6 is set as a new setting value. The present embodiment is configured in such a manner that an incremental/decremental value (a relative value) relative to the currently set value is input to the input portion 831, but is not limited thereto. The present embodiment may be configured in such a manner that a setting value (an absolute value) to be newly made is input to the input portion 831. The CPU 301 functions as the reception unit that receives the instruction to set the conveyance speed of the conveyance unit via the conveyance setting screen 830.

The adjustment value input to the input portion 831 can be changed by pressing a minus button 832 or a plus button 833. When the minus button 832 is pressed, −1 is applied to the numerical value displayed in the input portion 831. When the plus button 833 is pressed, +1 is applied to the numerical value displayed in the input portion 831. When the numerical value is changed by "1", the conveyance speed of the motor belonging to the unit is changed by a predetermined speed.

Then, when the setting instruction directed to the conveyance speed of the conveyance unit 421 targeted for the setting (the sheet conveyance of the conveyance unit before the fixing) is entered by pressing an OK button 835, the conveyance speed of the conveyance unit 421 is set to the image forming system 100 based on this instruction. Along therewith, the conveyance speed of the conveyance unit located downstream of the conveyance unit 421 selected by the user is set to the image forming system 100 based on this setting instruction. The conveyance units located downstream are the conveyance unit 422 (the sheet conveyance of the first fixing unit), the conveyance unit 423 (the sheet conveyance of the second fixing unit), the conveyance unit 424 (the sheet conveyance of the bypass unit), and the conveyance unit 425 (the sheet conveyance of the reversing/sheet discharge unit) in the example illustrated in FIG. 4.

According to such a configuration, the conveyance speed of the conveyance unit located on the downstream side in the conveyance route is automatically adjusted according to the issue of the instruction to adjust the conveyance speed of the conveyance unit located on the upstream side in the conveyance route.

Therefore, the conveyance speed can be kept consistent between the conveyance unit for which the conveyance speed is set by the user and the conveyance unit on the downstream side thereof even without the user being conscious of it. Further, the user can save time and effort required to set the conveyance speed of the downstream unit when adjusting the conveyance speed of one conveyance unit.

An application range 834 displayed on the conveyance setting screen 830 is a list of the other setting items (the other conveyance units) corresponding to the settings changed according to the input of the adjustment value to the input portion 831. In the example illustrated in FIG. 8C, the application range 834 indicates that the adjustment value input to the input portion 831 is also applied to the adjustment of the sheet conveyance of the first fixing unit, the adjustment of the sheet conveyance of the second fixing unit, the adjustment of the sheet conveyance of the bypass unit, and the adjustment of the sheet conveyance of the reversing/sheet discharge unit.

When the OK button 835 is pressed, the adjustment value input to the input portion 831 is applied to the image forming apparatus 101. On the other hand, when a cancel button 836 is pressed, the conveyance setting screen 830 is closed without the adjustment value input to the input portion 831 being applied to the image forming apparatus 101. The editing screen 810 has been described assuming that the image forming apparatus 101 is instructed to change the setting value of the adjustment of the sheet conveyance of the conveyance unit before the fixing 811 by way of example, but the same also applies to when another setting item is set.

The contents displayed in the application range 834 and the method for determining the application to the other setting items are similar to the contents described with reference to FIG. 6, and therefore the descriptions thereof will be omitted here.

However, the processing illustrated in FIG. 6 has been described regarding an implementation in which the processing is performed by the printing control apparatus 110 or the client computer 120 in the first embodiment, but is different in the present embodiment in terms of the fact that the processing illustrated in FIG. 6 is performed by the image forming apparatus 101. The processing illustrated in the flowchart of FIG. 6 is achieved by the CPU 201 of the image forming apparatus 101 executing the above-described program loaded in the RAM 202. In the present embodiment, the flow illustrated in FIG. 6 is started when any of the buttons 821 to 825 for changing the setting items is selected on the editing screen 810 illustrated in FIG. 8B. Further, assume that the table 700 illustrated in FIG. 7 is stored in the external storage device 211 of the image forming apparatus 101 in the present embodiment.

Further, when referring to the description of the flowchart illustrated in FIG. 6, the CPU 301 in the first embodiment is to be read as the CPU 201 in the present embodiment. Further, the editing screen 510 described in the first embodiment is to be read as the editing screen 810. Further, the conveyance setting screen 520 described in the first embodiment is to be read as the conveyance setting screen 830. Further, the application range 526 described in the first embodiment is to be read as the application range 834. Further, the OK button 527 is to be read as the OK button 835. Further, the cancel button 528 is to be read as the cancel button 836. Further, the input portion 522 described in the first embodiment is to be read as the input portion 831.

According to the present embodiment, the conveyance speed of the conveyance unit located on the downstream side in the conveyance route is also automatically adjusted according to the issue of the instruction to adjust the conveyance speed of the conveyance unit located on the upstream side in the conveyance route.

Therefore, the conveyance speed can be kept consistent between the conveyance unit for which the conveyance speed is set by the user and the conveyance unit on the downstream side thereof even without the user being conscious of it. Further, the user can save time and effort required to set the conveyance speed of the downstream unit when adjusting the conveyance speed of one conveyance unit.

Further, according to the processing for updating the setting value, which has been described with reference to FIG. 6, the speed of the conveyance unit located upstream of the conveyance unit for which the user issues the instruction to update the setting value in the conveyance route is not updated along with the update of the setting value by the user.

Therefore, the user can adjust the conveyance speed, targeting only a part of the conveyance units among the plurality of conveyance units.

The present embodiment may be configured to include a setting that allows the user to switch whether to enable or disable the function of automatically adjusting the setting value of the conveyance speed of the downstream conveyance unit based on the adjustment content of the conveyance speed of the upstream conveyance unit.

Third Embodiment

The present embodiment will be described regarding an embodiment in which a range where the user can increase/reduce the setting value (a range of a value) is displayed on the conveyance setting screen 520 described in the first embodiment or the conveyance setting screen 830 described in the second embodiment.

The present embodiment will be described regarding an implementation in which the range of a value of the conveyance unit, for which the user is intending to change the setting value such as to a predetermined setting value, is displayed in consideration of not only the range of a value of the conveyance unit for which the user is intending to change the setting value but also the range of a value of the conveyance unit located downstream of this conveyance unit.

In the first embodiment and the second embodiment, when the instruction to adjust the conveyance speed of the conveyance unit located upstream in the conveyance route is issued, the conveyance speed of the conveyance unit located downstream is also changed along therewith. At this time, the adjustment value input by the user may end up falling outside the range of a value of the conveyance speed of the conveyance unit located downstream even when falling within the range of a value of the conveyance speed of the conveyance unit located upstream. In such a case, the adjustment value specified by the user cannot be reflected in the conveyance unit located downstream.

For example, in the embodiment illustrated in FIG. 7, the current setting value of the "adjustment of the sheet conveyance of the first fixing unit" is "0", and the settable upper limit value and lower limit value are "+128" and "−128", respectively. In other words, the user can increase the value by "128" or reduce the value by "128" from the current value. Then, in the first or second embodiment, when the user increases the setting value of the "adjustment of the sheet conveyance of the first fixing unit" from "0" to "128", "+128", which is the adjustment amount, is also applied to the adjustment item of the conveyance unit downstream of the conveyance unit of the "adjustment of the sheet conveyance of the first fixing unit". In the embodiment illustrated in FIG. 7, the current value of the "adjustment of the sheet conveyance of the bypass unit" is set to "+30". When the adjustment amount "+128" is applied to this current value, the setting value is changed to "+158" after the adjustment. However, the upper limit value of the "adjustment of the sheet conveyance of the bypass unit" is "+128", and therefore the setting value ends up exceeding the upper limit value after the adjustment. If, to handle this case, in a case where the setting value of the "adjustment of the sheet conveyance of the bypass unit" is changed to "+128" corresponding to the upper limit value, this handling unintentionally makes a difference in the adjustment amount from the preceding and subsequent conveyance units, thereby raising a possibility of undesirably causing the inconsistency in the conveyance speed.

With the aim of improving this situation, the present embodiment will be described regarding the embodiment in which the range of a value of the conveyance unit selected by the user is displayed in consideration of not only the range of a value of the conveyance unit selected by the user but also the range of a value of the conveyance unit located downstream of the conveyance unit.

The configuration of a system according to the present embodiment is similar to the configuration described with reference to FIGS. 1 to 4 in the first embodiment, and therefore the description thereof will be omitted here.

(Display of Adjustment Range)

First, the present embodiment will be described based on an implementation in which the range where the user can increase/reduce the setting value (an adjustment range) is displayed on the conveyance setting screen 520 described in the first embodiment. The following content can also be applied to the conveyance setting screen 830 described in the second embodiment.

FIG. 9 illustrates the conveyance setting screen 520 for setting the conveyance speed of the "adjustment of the sheet conveyance of the first fixing unit" (the conveyance unit 422).

An adjustment range 901 indicates a range where the user can increase/reduce the value from the current value. The adjustment range 901 is information indicating a change amount by which the value can be changed from the current setting value of the conveyance speed. In this embodiment, as illustrated in FIG. 7, the current setting value of the "adjustment of the sheet conveyance of the first fixing unit" is "0", and the settable upper limit value and lower limit value are "+128" and "−128", respectively. In other words, the image forming system 100 has a capability of increasing the value by "128" or reducing the value by "128" from the current value "0" in terms of only the "adjustment of the sheet conveyance of the first fixing unit".

However, in the embodiment illustrated in FIG. 9, the setting application displays that the lower limit value and the upper limit value of the adjustment range are "−118" and "+98", respectively.

The upper limit value is displayed in this manner in consideration of the fact that the table 700 illustrated in FIG. 7 indicates that "+30" is set as the current value of the "adjustment of the sheet conveyance of the bypass unit" of the conveyance unit, which is located downstream of the conveyance unit of the "adjustment of the sheet conveyance of the first fixing unit", and the upper limit value is "+128", so that the value can be increased only by "98" corresponding to the difference between them.

Similarly, the lower limit value is also displayed in this manner in consideration of the fact that "−10" is set as the current value of the "adjustment of the sheet conveyance of the second fixing unit" of the conveyance unit, which is located downstream of the conveyance unit of the "adjustment of the sheet conveyance of the first fixing unit", and the lower limit value is "−128", so that the value can be reduced only by "118" corresponding to the difference between them.

In this manner, the settable range with respect to the conveyance unit selected by the user is displayed in consideration of how much the setting value can be increased/reduced from the current value with respect to not only the conveyance unit selected by the user but also the conveyance unit located downstream in the conveyance route.

According to the above-described processing, the setting range can be displayed so as not to exceed the adjustable range of the conveyance speed of the conveyance unit located downstream in such a configuration that the conveyance speed of the conveyance unit located downstream is also changed when the conveyance speed of the conveyance unit located upstream in the conveyance route is changed.

(Processing for Determining Adjustment Range)

Figure 10:
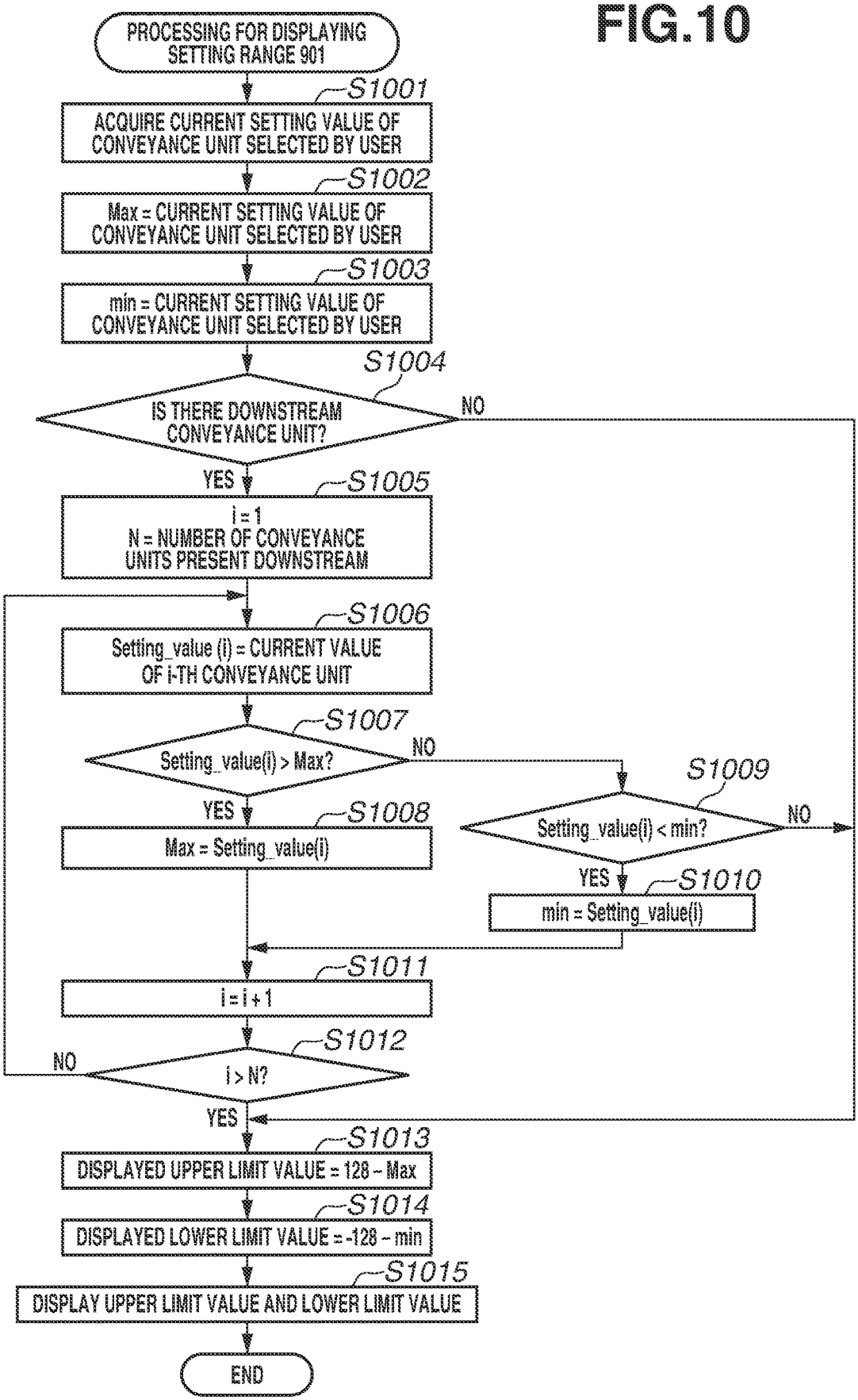
FIG. 10 is a flowchart illustrating a flow of processing for displaying a settable range 901 according to the third embodiment.

Processing for determining the adjustment range according to the present embodiment will be described with reference to FIG. 10. The processing illustrated in the flowchart of FIG. 10 is achieved by the CPU 301 executing the above-described program loaded in the RAM 302. In the present embodiment, the flow illustrated in FIG. 10 is started when the editing button 512 is selected after the setting item is selected on the editing screen 510 illustrated in FIG. 5C.

Even when the present embodiment is configured to cause the client computer 120 to perform the processing illustrated in FIG. 10 or cause the CPU 201 of the image forming apparatus 101 to perform it, similar advantageous effects can be exerted.

In step S1001, the CPU 301 acquires the current setting value with respect to the conveyance speed of the conveyance unit corresponding to the setting item selected by the user on the selection screen 513 (hereinafter referred to as the "conveyance unit selected by the user").

In step S1002, the CPU 301 substitutes the setting value acquired in step S1001 into a value of a variable name "Max". The variable name "Max" is a variable name for identifying the largest setting value among the setting values of the conveyance speeds of the conveyance unit selected by the user and the conveyance unit(s) located downstream thereof.

In step S1003, the CPU 301 substitutes the setting value acquired in step S1001 into a variable name "min". The variable name "min" is a variable name for identifying the smallest setting value among the setting values of the conveyance speeds of the conveyance unit selected by the user and the conveyance unit(s) located downstream thereof.

In step S1004, the CPU 301 determines whether there is any conveyance unit downstream of the conveyance unit selected by the user. The CPU 301 can perform the processing of step S1004 by referring to the conveyance order column 702 in the table 700 illustrated in FIG. 7.

If there is no conveyance unit downstream of the conveyance unit selected by the user (NO in step S1004), the processing proceeds to step S1013.

On the other hand, if there is a conveyance unit downstream of the conveyance unit selected by the user (YES in step S1004), the processing proceeds to step S1005.

In step S1005, the CPU 301 substitutes 1 into a variable name "i". The variable name "i" is a variable name for identifying the conveyance unit targeted for the processing from steps S1006 to S1011 among the conveyance unit(s) downstream of the conveyance unit selected by the user.

Further, in step S1005, the CPU 301 substitutes the number of conveyance units downstream of the selected conveyance unit into a variable name "N". The CPU 301 can identify the number of conveyance units downstream of the selected conveyance unit by referring to the conveyance order column 702 in the table 700 illustrated in FIG. 7.

In step S1006, the CPU 301 substitutes the current setting value of the conveyance speed of the i-th conveyance unit into a variable name "Setting_value (i)". The CPU 301 can identify the current setting value of the conveyance speed of each of the conveyance units by referring to the setting value column 705 in the table 700 illustrated in FIG. 7.

In step S1007, the CPU 301 compares the value of "Setting_value (i)" and the value of "Max". If the value of "Setting_value (i)" is larger than the value of "Max" (YES in step S1007), the processing proceeds to step S1008. On the other hand, if the value of "Setting_value (i)" is equal to or smaller than the value of "Max" (NO in step S1007), the processing proceeds to step S1009.

In step S1008, the CPU 301 substitutes the value of "Setting_value (i)" into "Max". Then, the processing proceeds to step S1011.

In step S1009, the CPU 301 compares the value of "Setting_value (i)" and the value of "min". If the value of "Setting_value (i)" is smaller than the value of "min" (YES in step S1009), the processing proceeds to step S1010. On the other hand, if the value of "Setting_value (i)" is equal to or larger than the value substituted in "min" (NO in step S1009), the processing proceeds to step S1013.

In step S1010, the CPU 301 substitutes the value of "Setting_value (i)" into "min". Then, the processing proceeds to step S1011.

In step S1011, the CPU 301 increments "i".

In step S1012, the CPU 301 determines whether the value of "i" exceeds N. If the value of "i" does not exceed N (NO in step S1012), the CPU 301 repeats the processing from steps S1006 to S1011. On the other hand, if the value of "i" exceeds N (YES in step S1012), the processing proceeds to step S1013.

By the processing from steps S1006 to S1011, the largest value and the smallest value are identified among the setting values of the conveyance speeds of the conveyance unit selected by the user and the conveyance unit(s) located downstream thereof.

In step S1013, the CPU 301 determines to set a value resulting from subtracting the value of "Max" from "+128", which is the upper limit value indicated in the table 700, as the upper limit value that is to be displayed in the adjustment range 901.

In step S1014, the CPU 301 determines to set a value resulting from subtracting the value of "min" from "−128", which is the lower limit value indicated in the table 700, as the lower limit value that is to be displayed in the adjustment range 901.

In step S1015, the CPU 301 displays the values determined in steps S1013 and S1014 in the adjustment range 901, and ends the processing.

According to the above-described processing, the setting range can be displayed so as not to exceed the adjustable range of the conveyance speed of the downstream conveyance unit in such a configuration that the conveyance speed of the conveyance unit located downstream is also changed when the conveyance speed of the conveyance unit located upstream in the conveyance route is changed.

Therefore, the user can save time and effort required to determine the setting value of the upstream adjustment unit after confirming the setting value of the downstream adjustment unit.

Further, the conveyance setting screen 520 may be presented to, for example, prohibit the user from setting an adjustment value exceeding the adjustment range identified by the processing illustrated in FIG. 9 or display a message indicating that the setting is invalid when the user attempts to set an adjustment value exceeding the adjustment range.

Presenting the display in this manner allows the user to set the setting value so as not to exceed the adjustable range of the conveyance speed of the downstream conveyance unit, in such a configuration that the conveyance speed of the conveyance unit located downstream is also changed when the conveyance speed of the conveyance unit located upstream in the conveyance route is changed.

Therefore, the conveyance speed can be kept consistent between the conveyance unit for which the conveyance speed is set by the user and the conveyance unit on the downstream side thereof even without the user being conscious of it. Further, the user can save time and effort required to set the conveyance speed of the downstream unit when adjusting the conveyance speed of one conveyance unit.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to embodiments, it is to be understood that the disclosure is not limited to the disclosed embodiments. The scope of the following claims is to be accorded the broadest interpretation to encompass all such modifications and equivalent structures and functions.

What is claimed is:

1. An information processing apparatus configured to control an image forming system, wherein the image forming system includes a first conveyance unit configured to convey a recording medium, a second conveyance unit located downstream of the first conveyance unit in a conveyance route of the recording medium, and a third conveyance unit located downstream of the second conveyance unit, the information processing apparatus comprising:

a reception unit configured to receive an instruction to change a conveyance speed of the recording medium by the second conveyance unit; and a control unit configured to cause the image forming system to change the conveyance speed of the recording medium by the second conveyance unit based on the instruction, and to cause the image forming system to change at least a conveyance speed of the recording medium by the third conveyance unit based on the instruction without causing the image forming system to change at least a conveyance speed of the recording medium by the first conveyance unit based on the instruction.

2. The information processing apparatus according to claim 1, further comprising a display control unit configured to cause a display to display information indicating that the conveyance speed of the recording medium by the third conveyance unit is set based on the instruction to change the conveyance speed of the recording medium by the second conveyance unit.

3. The information processing apparatus according to claim 2, wherein the displayed information is displayed according to a-display of a setting screen for setting the conveyance speed of the recording medium by the second conveyance unit.

4. The information processing apparatus according to claim 1, wherein the control unit is arranged to cause the image forming system to change the conveyance speed of the recording medium by the third conveyance unit based on an amount by which a setting value of the conveyance speed of the recording medium by the second conveyance unit is changed due to the instruction.

5. The information processing apparatus according to claim 1, wherein the control unit is configured to set a value of the conveyance speed of the recording medium by the second conveyance unit for each type of the recording medium.

6. The information processing apparatus according to claim 1, further comprising a display control unit configured to cause information to be displayed indicating a change amount by which a value can be changed from a current setting value of the recording medium by the conveyance speed of the recording medium by the second conveyance unit.

7. The information processing apparatus according to claim 6, wherein the change amount is determined based on a conveyance speed of the recording medium by at least one conveyance unit located downstream of the second conveyance unit in the conveyance route.

8. The information processing apparatus according to claim 1, wherein the information processing apparatus is a printing control apparatus configured to communicate with the image forming system via a communication line.

9. The information processing apparatus according to claim 1, wherein the information processing apparatus is an image forming apparatus.

10. The information processing apparatus according to claim 1, wherein the image forming system includes an image forming apparatus.

11. The information processing apparatus according to claim 1, wherein the image forming system includes a sheet feeding apparatus or a sheet discharge apparatus.

12. A method for an information processing apparatus configured to control an image forming system, wherein the image forming system includes a first conveyance unit configured to convey a recording medium, a second conveyance unit located downstream of the first conveyance unit in a conveyance route of the recording medium, and a third conveyance unit located downstream of the second conveyance unit, the method comprising:

receiving an instruction to change a conveyance speed of the recording medium by the second conveyance unit; and causing the image forming system to change the conveyance speed of the recording medium by the second conveyance unit based on the instruction, and causing the image forming system to change at least a conveyance speed of the recording medium by the third conveyance unit based on the instruction without causing the image forming system to change at least a conveyance speed of the recording medium by the first conveyance unit based on the instruction.

13. A non-transitory computer-readable storage medium storing a program to cause a computer to perform a method for an information processing apparatus configured to control an image forming system, wherein the image forming system includes a first conveyance unit configured to convey a recording medium, a second conveyance unit located downstream of the first conveyance unit in a conveyance route of the recording medium, and a third conveyance unit located downstream of the second conveyance unit, the method comprising:

receiving an instruction to change a conveyance speed of the recording medium by the second conveyance unit; and causing the image forming system to change the conveyance speed of the recording medium by the second conveyance unit based on the instruction, and causing the image forming system to change at least a conveyance speed of the recording medium by the third conveyance unit based on the instruction without causing the image forming system to change at least a conveyance speed of the recording medium by the first conveyance unit based on the instruction.

14. An image forming system including a first conveyance unit for conveying a recording medium, a second conveyance unit located downstream of the first conveyance unit in a conveyance route of the recording medium, and a third conveyance unit located downstream of the second conveyance unit, the information processing apparatus comprising:

a reception unit configured to receive an instruction to change a conveyance speed of the recording medium by the second conveyance unit; and a changing unit configured to change the conveyance speed of the recording medium by the second conveyance unit based on the instruction, and to change at least a conveyance speed of the recording medium by the third conveyance unit based on the instruction without changing at least a conveyance speed of the recording medium by the first conveyance unit based on the instruction.

* * * * *